US008268522B2

(12) United States Patent
Kadokura et al.

(10) Patent No.: US 8,268,522 B2
(45) Date of Patent: Sep. 18, 2012

(54) TONER SET FOR ELECTROSTATIC IMAGE DEVELOPMENT, IMAGE FORMING METHOD AND IMAGE FORMING APPARATUS

(75) Inventors: Yasuo Kadokura, Kanagawa (JP); Yusuke Ikeda, Kanagawa (JP); Yukiaki Nakamura, Kanagawa (JP); Masanobu Ninomiya, Kanagawa (JP); Susumu Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 394 days.

(21) Appl. No.: 12/563,722

(22) Filed: Sep. 21, 2009

(65) Prior Publication Data

US 2010/0183966 A1 Jul. 22, 2010

(30) Foreign Application Priority Data

Jan. 16, 2009 (JP) ..... 2009-007818

(51) Int. Cl.
*G03G 9/00* (2006.01)

(52) U.S. Cl. ..... 430/107.1; 430/110.1; 430/109.4; 399/252

(58) Field of Classification Search ..... 430/107.1, 430/110.1, 109.4; 399/252
See application file for complete search history.

(56) References Cited

U.S. PATENT DOCUMENTS

| | | | | |
|---|---|---|---|---|
| 4,913,991 | A | 4/1990 | Chiba et al. | |
| 6,221,548 | B1 | 4/2001 | Shiba et al. | |
| 6,728,508 | B2 * | 4/2004 | Kabashima et al. | 399/349 |
| 2003/0207186 | A1 | 11/2003 | Itakura et al. | |
| 2005/0070631 | A1 | 3/2005 | Itakura et al. | |
| 2005/0214669 | A1 * | 9/2005 | Hayashi et al. | 430/109.4 |
| 2006/0204880 | A1 | 9/2006 | Mizutani et al. | |
| 2007/0031747 | A1 | 2/2007 | Itakura et al. | |
| 2007/0048653 | A1 | 3/2007 | Ide | |
| 2009/0011356 | A1 | 1/2009 | Tomita et al. | |

FOREIGN PATENT DOCUMENTS

| | | | |
|---|---|---|---|
| EP | 1795971 | * | 6/2007 |
| JP | A-63-259575 | | 10/1988 |
| JP | A-3-2765 | | 1/1991 |
| JP | A-5-142963 | | 6/1993 |
| JP | A-5-158364 | | 6/1993 |
| JP | A-2000-89505 | | 3/2000 |
| JP | A-2003-280278 | | 10/2003 |

(Continued)

OTHER PUBLICATIONS

Notification of Reasons for Refusal for corresponding Japanese Patent Application No. 2009-007818, mailed on Nov. 16, 2010 (w/ English translation).

*Primary Examiner* — Thorl Chea
(74) *Attorney, Agent, or Firm* — Oliff & Berridge, PLC

(57) ABSTRACT

A toner set for electrostatic image development, includes: at least one kind of a colored toner that contains a coloring agent; and a transparent toner that does not substantially contain a coloring agent, wherein a proportion of particles having a shape factor of 0.94 or less in mother particles of the transparent toner is about 5% by number or less based on particles having a particle diameter of 7.5 to 15 μm, and a reflectance of the mother particles of the transparent toner is about 90% or more for light at a wavelength of 700 nm.

20 Claims, 1 Drawing Sheet

FOREIGN PATENT DOCUMENTS

| | | |
|---|---|---|
| JP | A-2004-341242 | 12/2004 |
| JP | A-2004-361790 | 12/2004 |
| JP | A-2005-99122 | 4/2005 |
| JP | A-2005-274614 | 10/2005 |
| JP | A-2005-283653 | 10/2005 |
| JP | A-2006-251564 | 9/2006 |
| JP | A-2006-267731 | 10/2006 |
| JP | A-2007-57718 | 3/2007 |
| JP | A-2007-121462 | 5/2007 |
| JP | A-2007-279652 | 10/2007 |
| JP | A-2008-129410 | 6/2008 |

* cited by examiner

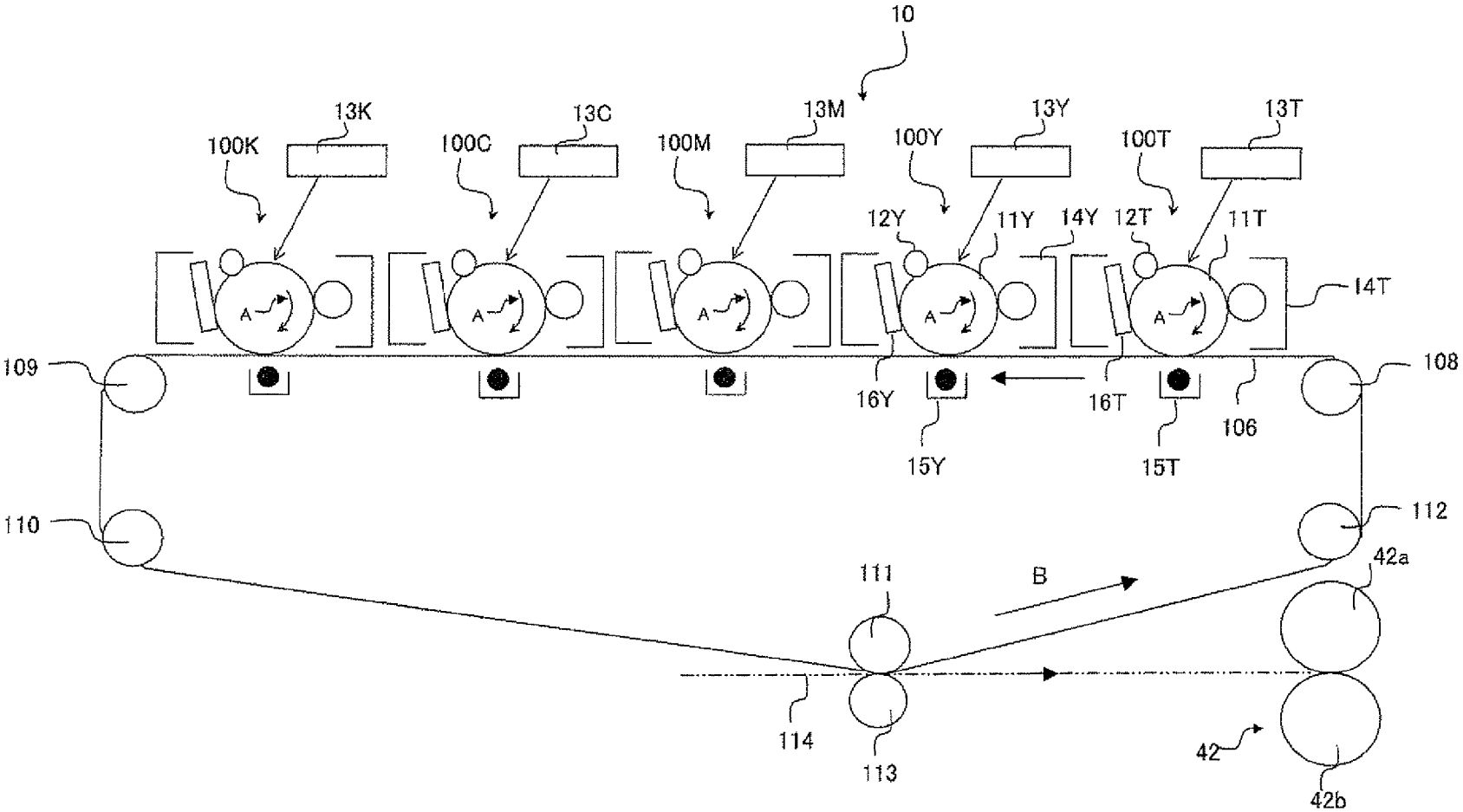
10
13T
13Y
13M
13C
13K
100T
100Y
100M
100C
100K
11T
11Y
12T
12Y
14T
14Y
15T
15Y
16T
16Y
106
108
109
110
111
112
113
114
42
42a
42b
A
B

TONER SET FOR ELECTROSTATIC IMAGE DEVELOPMENT, IMAGE FORMING METHOD AND IMAGE FORMING APPARATUS

CROSS-REFERENCE TO RELATED APPLICATION

This application is based on and claims priority under 35 USC 119 from Japanese Patent Application No. 2009-007818 filed Jan. 16, 2009.

BACKGROUND

1. Technical Field

The present invention relates to a toner set for electrostatic image development, an image forming method and an image forming apparatus.

2. Related Art

Conventionally, in a color image forming apparatus of forming a color image, for example, by an electrophotographic system or an electrostatic recording system, when forming a color image on a recording medium surface, for example, when making a color copy, an operation including the following image forming steps is performed.

That is, light is applied to a color original, the reflected light image is color-separated and read by a color scanner, a predetermined image processing or color correction is performed, a semiconductor laser or the like is modulated based on the obtained image signals of a plurality of colors, and a laser beam modulated in accordance with the image signals is output from the semiconductor laser. This laser beam is irradiated a plurality of times for each color on the surface of an inorganic photoreceptor such as Se and amorphous silicon or an organic photoreceptor using a phthalocyanine pigment, a bisazo pigment or the like as a charge generating layer, whereby a plurality of electrostatic latent images are formed. The plurality of electrostatic latent images formed on the inorganic or organic photoreceptor surface are sequentially developed each time, for example, with four color toners of yellow (Y), magenta (M), cyan (C) and black (K). The developed toner images are transferred onto a recording medium surface such as paper from the inorganic or organic photoreceptor and fixed (for example, fixed under heating) in a fixing device composed of a heat fixing roll and the like, whereby a color image is formed on the recording medium surface.

Such a color image has a certain degree of gloss because its surface is smoothed at the fixing (for example, fixing under heating), whereas the surface of normal paper does not have gloss, as a result, the color image comes to have a glossiness different from the paper surface. Also, the viscosity of the toner varies during fixing, for example, depending on the kind of the binder resin used for the color toner or the fixing system, and this is known to bring about a change in the glossiness of the color image.

The preference in glossiness of a color image differs, for example, depending on the kind of the image or the intended use and is of great variety, but in the case of a photographic original of figure, scenery or the like, a high-gloss image tends to generally have the preference from the standpoint of obtaining a clear image.

SUMMARY

According to an aspect of the invention, there is provided a toner set for electrostatic image development, including:

at least one kind of a colored toner that contains a coloring agent; and a transparent toner that does not substantially contain a coloring agent, wherein a proportion of particles having a shape factor of 0.94 or less in mother particles of the transparent toner is about 5% by number or less based on particles having a particle diameter of 7.5 to 15 μm, and a reflectance of the mother particles of the transparent toner is about 90% or more for light at a wavelength of 700 nm.

BRIEF DESCRIPTION OF THE DRAWING

Exemplary embodiments of the present invention will be described in detail based on the following FIGURE, wherein:

the drawing is a schematic configuration diagram showing one example of the image forming apparatus of this exemplary embodiment.

DETAILED DESCRIPTION

1. Toner Set for Electrostatic Image Development

The toner set for electrostatic image development of this exemplary embodiment (hereinafter sometimes simply referred to as a "toner set") is composed of at least one kind of a colored toner containing a coloring agent and a transparent toner not containing a coloring agent, wherein the proportion of a particle having a shape factor of 0.94 or less in the mother particle of the transparent toner is 5% by number or less or about 5% by number or less based on particles having a particle diameter of 7.5 to 15 μm and the reflectance of the mother particle of the transparent toner (hereinafter sometimes referred to as a "transparent toner mother particle") is 90% or more or about 90% or more for light at a wavelength of 700 nm.

The toner set for electrostatic image development of this exemplary embodiment intends to reduce the gloss difference between the image area and the non-image area in the image region containing an image formed by a colored toner. In the image area where an image is formed by a colored toner, gloss unevenness is sometimes generated due to a difference between the gloss of the recording medium and the gloss of the image formed by a colored image. Also, in the case where a multicolor image is formed, gloss unevenness may occur within the image depending on the amount of toner applied. According to the toner set of this exemplary embodiment, a transparent toner is applied to such an image region, whereby gloss unevenness in the image region is improved.

More specifically, in the case where a photographic image is formed in a part of a recording medium or a character image is formed in another part, color unevenness becomes a problem particularly in the photographic image area. The transparent toner is preferably applied to a region where a photographic image is formed, or to a region containing the periphery of the photographic image region.

Incidentally, in this exemplary embodiment, unless otherwise indicated, the expression "from a to b" denoting a numeric range means "a or more and b or less", that is, a numeric range containing the end points a and b.

The toner set for electrostatic image development of this exemplary embodiment is described in detail below.

(Transparent Toner)

In this exemplary embodiment, the transparent toner contains a binder resin and does not substantially contain a coloring agent.

The expression "does not substantially contain a coloring agent" as used herein means that the content of a coloring agent in the transparent toner is 1 wt % or less based on the entire transparent toner. The content is preferably 0.1 wt % or less, and it is more preferred to contain no coloring agent. Incidentally, coloration by trace impurities or slight coloration by each component contained in the transparent toner is permitted. Also, in view of color adjustment, the transparent toner may contain a very small amount of a coloring agent, for example, by adding a slight amount of a blue pigment. From the standpoint of keeping the brightness of an image, a coloring agent may be used in the range of 1 wt % or less, but it is preferred to contain no coloring agent.

<Proportion of Particle Having Shape Factor of 0.94 or Less in Transparent Toner Mother Particle>

In this exemplary embodiment, the proportion of a particle having a shape factor of 0.94 or less in the transparent toner mother particle is 5% by number or less based on particles having a particle diameter of 7.5 to 15 μm. This proportion means that in the transparent toner mother particle having a relatively large particle diameter, the number of toner mother particles having a nearly amorphous shape is small. If the proportion of a particle having a shape factor of 0.94 or less in the transparent mother particle exceeds 5% by number based on particles having a particle diameter of 7.5 to 15 μm, gloss unevenness in the non-image area may be generated.

The proportion of a particle having a shape factor of 0.94 or less is preferably 4% by number or less, more preferably 3% by number of less, still more preferably 2% by number or less, based on particles having a particle diameter of 7.5 to 15 μm.

The shape factor is determined according to the following formula. The shape factor is 1 for a perfect sphere and becomes smaller as the shape deviates from a sphere.

Shape factor=(circumferential length of a circle having the same projected area as a particle image)/(circumferential length of a particle projected image)

The shape factor of the toner can be measured using a flow-type particle analyzer FPIA2100 (manufactured by Hosokawamicron Corporation). The measurement conditions are as follows.

Pretreatment:

The toner (300 mg) is diluted with 20 ml of pure water and after being wetted with an aqueous surfactant solution, subjected to a dispersion treatment by an ultrasonic wave for 3 minutes.

Measurement Condition:

HPF Measurement mode (high magnification photographing mode)

Amount analyzed: 0.35 μL

Number count of particles: from 1,500 to 5,000

Analysis conditions:

Limited range of particle diameter:

from 0.60 to 10.05 μm (equivalent-circle diameter)

Limited range of circularity: from 0.40 to 1.00

Also, the shape factor of the entire transparent toner mother particle is preferably from 0.950 to 0.975 or about 0.950 to about 0.975, more preferably from 0.955 to 0.970 or about 0.955 to about 0.970, still more preferably from 0.960 to 0.965 or about 0.960 to about 0.965.

When the shape factor of the transparent toner mother particle is in the range above, contact of the transparent toner with the carrier can be successfully maintained. When the shape factor is 0.975 or less, the area of the contact point between the transparent toner and the carrier is appropriate to allow a high-speed increase in the charge amount of a newly added transparent toner and the proportion of a toner with a low charge amount is relatively decreased, so that fogging can be suppressed. Also, when the shape factor is 0.950 or more, the probability of point contact of the transparent toner with the carrier is in an appropriate range and an excessive pressure is not imposed on the contact portion between the transparent toner and the carrier, as a result, the coat resin of the carrier can be kept from being shaved by an external additive or the like contained in the transparent toner, which advantageously ensures an excellent charge amount.

The shape factor of the transparent toner can be controlled to a necessary range by adjusting, for example, the fusing temperature, fusing time or pH at the fusion. These conditions vary depending on the molecular weight of binder resin, glass transition temperature, amount of crosslinking material, species of crosslinking material, amount of release agent, melting temperature of release agent, or coloring agent content, but in general, the shape is likely to be small under low viscosity conditions (for example, the fusing temperature is high, the molecular weight of resin is low, the glass transition temperature is low, the amount of crosslinking material is small, the amount of release agent is large, the melting temperature of release agent is low, or the coloring agent content is small). Similarly, the shape factor tends to be small when the fusing time is long or the pH at the fusion is low. The shape factor can be controlled to the range above by selecting these conditions.

<$D_{50V}$, GSDv, GSDp>

In this exemplary embodiment, the volume average particle diameter $D_{50V}$ of the transparent toner is preferably from 3.0 to 9.0 μm, more preferably from 3.0 to 8.0 μm, still more preferably from 3.0 to 7.0 μm. When $D_{50V}$ is in this range, strong adherence and good developability as well as excellent image resolution are advantageously ensured.

Also, the volume average particle size distribution index (GSDv) of the obtained toner is preferably 1.30 or less. When GSDv is 1.30 or less, good resolution and no generation of a cause of image defect, such as toner flying or fogging, are advantageously ensured.

The number average particle size distribution index (GSDp) of the obtained toner is preferably 1.40 or less, more preferably 1.31 or less, still more preferably from 1.20 to 1.27. When GSDp is in this range, good resolution and no generation of a cause of image defect, such as toner flying or fogging, are advantageously ensured.

Here, the volume average particle diameter $D_{50V}$, the number average particle size distribution index (GSDp), the volume average particle size distribution index (GSDv) and the like can be measured, for example, by Coulter Multisizer Model II (manufactured by Beckman Coulter Inc.). An accumulated distribution of each of the volume and the number of individual particles is drawn from the small diameter side with respect to the particle size range (channel) divided on the basis of the toner particle size distribution, where the particle diameter at 16% accumulation is defined as $D_{16V}$ by volume and $D_{16P}$ by number, the particle diameter at 50% accumulation is defined as $D_{50V}$ by volume and $D_{50P}$ by number, and the particle diameter at 84% accumulation is defined as $D_{84V}$ by volume and $D_{84P}$ by number. Using these, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

<Reflectance of Transparent Toner Mother Particle>

In this exemplary embodiment, the reflectance of the mother particle of the transparent toner (transparent toner mother particle) for light at a wavelength of 700 nm is 90% or more or about 90% or more, preferably 93% or more or about 93% or more, more preferably 95% or more or about 95% or more.

When the light reflectance is in this range, the transparency is high and gloss unevenness in the image region is effectively cancelled.

The reflectance of the transparent toner mother particle for light at a wavelength of 700 nm is a value obtained by measuring the particle still in a powder state and is measured using a spectral color difference meter "SE-2000" (manufactured by Nippon Denshoku Industries Co., Ltd.) in accordance with JIS Z-8722 and using a C light source as the light source in a 2° viewing field. The measurement is performed following the attached instruction manual, but standardization of a standard plate is preferably performed in a state of a 2 mm-thick glass of 30 mm in diameter being placed in an optional cell for powder measurement. More specifically, the measurement is performed in a state of a cell filled with a sample powder being placed on a sample table (attachment) for a powder sample of the spectral color difference meter above. Incidentally, the powder sample is filled in the cell to account for 80% or more of the internal volume of the cell before placing the cell on the sample table for a powder sample, and the measurement is performed after applying vibration at one vibration/sec on a vibrating table for 30 seconds.

<Binder Resin>

The transparent toner preferably contains, as the binder resin, a crystalline polyester resin and a noncrystalline polyester resin. By containing both a crystalline polyester resin and a noncrystalline polyester resin, both good fixability and gloss-imparting property are satisfied.

Incidentally, the transparent toner preferably contains, as the binder resin, a crystalline polyester resin and a noncrystalline polyester resin and may further contain other resin components.

As for the crystalline polyester resin, one kind may be used alone, or two or more kinds may be used in combination. Also, as for the noncrystalline polyester, one kind may be used alone, or two or more kinds may be used in combination, and this is not particularly limited.

In the transparent toner, the content of the crystalline polyester resin is preferably from 2 to 10 wt % or about 2 to about 10 wt %, more preferably from 2 to 8 wt % or about 2 to about 8 wt %, still more preferably from 2 to 6 wt % or about 2 to about 6 wt %, yet still more preferably from 2 to 4 wt % or about 2 to about 4 wt %, based on the entire binder resin. The content of the crystalline polyester resin is preferably in the range above from the standpoint that charging characteristics can be satisfied at the same time while maintaining the low-temperature fixability.

In the transparent toner, the content of the noncrystalline polyester resin is preferably from 0 to 98 wt %, more preferably from 50 to 98 wt %, still more preferably from 96 to 98 wt %, based on the entire binder resin.

The content of the noncrystalline polyester resin is preferably in the range above, because the compatibility with the crystalline polyester resin is enhanced and therefore, the viscosity of the noncrystalline polyester is reduced along with reduction in the viscosity of the crystalline polyester resin at its melting temperature, as a result, a sharp melting property as a toner is obtained, which is advantageous in view of low-temperature fixability.

Incidentally, the transparent toner may contain other resins as the binder resin, in addition to the crystalline polyester resin and the noncrystalline polyester resin.

Here, the term "crystalline" in the "crystalline polyester resin" indicates that the differential scanning calorimetry (DSC) shows a distinct endothermic peak but not a stepwise endothermic change and specifically, the half-value width of the endothermic peak when measured at a temperature rising rate of 10° C./min is within 15° C.

On the other hand, when the half-value width of the endothermic peak exceeds 15° C. or a distinct endothermic peak is not observed, this means that the resin is noncrystalline (amorphous).

In this exemplary embodiment, the "polyester resin" used in the transparent toner and the later-described colored toner includes not only a polymer with its constituent component being composed of a 100% polyester structure but also a polymer (copolymer) obtained by copolymerizing a polyester-constituting component with other components. However, in the latter case, the proportion of the constituent component other than the polyester constituting the polymer (copolymer) is less than 50 wt %.

In this exemplary embodiment, as described above, the transparent toner preferably contains, as the binder resin, a crystalline polyester resin and a noncrystalline polyester resin. The crystalline and noncrystalline polyester resins are obtained by polycondensing at least one member selected from the group consisting of polycondensable monomers and their oligomers and prepolymers. The crystalline and noncrystalline polyester resins that are suitably used in this exemplary embodiment are described below.

[Polyester Resin]

The polycondensable monomer used in a polycondensation reaction for synthesizing a polyester resin includes, for example, a polycarboxylic acid and a polyol. The polyester resin is preferably a polyester resin obtained by using, as the polycondensable monomer, a polycarboxylic acid and a polyol. It is more preferred to use a dicarboxylic acid as the polyvalent carboxylic acid and a diol as the polyol.

In this exemplary embodiment, examples of the polycarboxylic acid include a polycarboxylic acid such as aliphatic, alicyclic or aromatic polycarboxylic acid and hydroxycarboxylic acid, and an alkyl ester thereof, and examples of the polyol include a polyhydric alcohol, an ester compound thereof and a hydroxycarboxylic acid. The polyester resin can be produced by performing polycondensation through a direct esterification reaction, a transesterification reaction or the like using a polycondensable monomer. In this case, the polymerized polyester resin takes any one form of an amorphous (noncrystalline) polyester, a crystalline polyester and the like, or a mixed form thereof.

The polycarboxylic acid used as the polycondensable monomer is a compound containing two or more carboxy groups in one molecule.

Out of these compounds, the divalent polycarboxylic acid is a compound containing two carboxy groups in one molecule, and examples thereof include oxalic acid, succinic acid, maleic acid, itaconic acid, adipic acid, glutaric acid, β-methyladipic acid, azelaic acid, sebacic acid, suberic acid, nonanedicarboxylic acid, decanedicarboxylic acid, undecanedicarboxylic acid, dodecanedicarboxylic acid, tetradecanedicarboxylic acid, octadecanedicarboxylic acid, fumaric acid, citraconic acid, diglycolic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, cyclohexanedicarboxylic acid, cyclohexenedicarboxylic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracenedicarboxylic acid, norbornene-2,3-dicarboxylic acid, adamantanedicarboxylic acid and adamantanediacetic acid.

Examples of the trivalent or greater polycarboxylic acid include trimellitic acid, pyromellitic acid, naphthalenetricarboxylic acid, naphthalenetetracarboxylic acid, pyrenetricarboxylic acid, pyrenetetracarboxylic acid, mesaconic acid, and lower esters thereof and also include acid chlorides of the above-described polycarboxylic acids, but this exemplary embodiment is not limited thereto.

One kind of these polycarboxylic acids may be used alone, or two or more kinds thereof may be used in combination. Furthermore, other than the above-described aliphatic dicarboxylic acid or aromatic dicarboxylic acid, a dicarboxylic acid component having a double bond is sometimes contained.

The polyol used in this exemplary embodiment is a compound containing two or more hydroxyl groups in one molecule. Examples of the diol having two hydroxyl groups in one molecule include ethylene glycol, propylene glycol, butanediol, butenediol, neopentyl glycol, pentane glycol, hexane glycol, heptanediol, cyclohexanediol, cyclohexanedimethanol, diethylene glycol, triethylene glycol, dipropylene glycol, octanediol, nonanediol, decanediol, dodecanediol, dodecanediol, tridecanediol, tetradecanediol, octadecanediol, eicosanedecanediol, diethylene glycol, triethylene glycol, polyethylene glycol, dipropylene glycol, polypropylene glycol, polytetramethylene glycol, bisphenol A, bisphenol Z and hydrogenated bisphenol A.

Examples of the polyol having three or more hydroxyl groups in one molecule include glycerin, pentaerythritol, hexamethylolmelamine, hexaethylolmelamine, tetramethylolbenzoguanamine and tetraethylolbenzoguanamine.

One of these polyols may be used alone, or two or more kinds thereof may be used in combination.

—Crystalline Polyester Resin—

In this exemplary embodiment, the transparent toner preferably contains a crystalline polyester resin as the binder resin.

Examples of the polycarboxylic acid used for obtaining a crystalline polyester resin include, out of the carboxylic acids above, oxalic acid, malonic acid, succinic acid, glutaric acid, adipic acid, pimelic acid, suberic acid, azelaic acid, sebacic acid, an aliphatic dicarboxylic acid (e.g., 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid), sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and an acid anhydride, lower ester or acid chloride thereof.

Examples of the diol used for obtaining a crystalline polyester resin include ethylene glycol, diethylene glycol, triethylene glycol, polyethylene glycol, 1,2-propylene glycol, 1,3-propylene glycol, dipropylene glycol, polypropylene glycol, 1,4-butanediol, 1,4-butenediol, neopentyl glycol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, polytetramethylene ether glycol, 1,4-cyclohexanediol, 1,4-cyclohexanedimethanol and polytetramethylene glycol.

Also, a dihydric or greater polyhydric alcohol is used in combination. Examples thereof include glycol, pentaerythritol, hexamethylolmelamine, hexaethylolmelamine, tetramethylolbenzoguanamine and tetraethylolbenzoguanamine.

The crystalline polyester resin includes a polyester resin obtained by reacting 1,9-nonanediol with 1,10-decanedicarboxylic acid, a polyester resin obtained by reacting 1,9-nonanediol with azelaic acid, a polyester resin obtained by reacting cyclohexanediol with adipic acid, a polyester resin obtained by reacting 1,9-nonanediol with sebacic acid, a polyester resin obtained by reacting 1,6-hexanediol with sebacic acid, a polyester resin obtained by reacting ethylene glycol with succinic acid, a polyester resin obtained by reacting ethylene glycol with sebacic acid, and a polyester resin obtained by reacting 1,4-butanediol with succinic acid. Among these, preferred are a polyester resin obtained by reacting 1,9-nonanediol with 1,10-decanedicarboxylic acid, a polyester resin obtained by reacting 1,9-nonanediol with azelaic acid, a polyester resin obtained by reacting 1,9-nonanediol with sebacic acid and a polyester resin obtained by reacting 1,6-hexanediol with sebacic acid.

—Noncrystalline Polyester Resin—

In this exemplary embodiment, the transparent toner and the later-described colored toner each preferably contains, as the binder resin, a noncrystalline polyester resin, and the transparent toner more preferably uses, as the binder resin, a crystalline polyester resin and a noncrystalline polyester resin in combination.

Examples of the divalent carboxylic acid used for obtaining a noncrystalline polyester resin include phthalic acid, isophthalic acid, terephthalic acid, tetrachlorophthalic acid, chlorophthalic acid, nitrophthalic acid, malonic acid, mesaconic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, cyclohexenedicarboxylic acid, norbornene-2,3-dicarboxylic acid, adamantanedicarboxylic acid and adamantanediacetic acid.

Examples of the trivalent or greater carboxylic acid include trimellitic acid, pyromellitic acid, naphthalenetricarboxylic acid, naphthalenetetracarboxylic acid, pyrenetricarboxylic acid and pyrenetetracarboxylic acid.

Also, those where the carboxy group of these polycarboxylic acids is derived to an acid anhydride, an acid chloride, a lower ester or the like may be used. Incidentally, the lower ester indicates an ester with an aliphatic alcohol having a carbon number of 1 to 8.

Among these, preferred are terephthalic acid or a lower ester thereof, phenylenediacetic acid, phenylenedipropanoic acid and cyclohexanedicarboxylic acid, more preferred are 1,4-phenylenediacetic acid, 1,4-phenylenedipropanoic acid and 1,4-cyclohexanedicarboxylic acid.

As regards the polyol used for obtaining a noncrystalline polyester, out of the polyols above, polytetramethylene glycol, bisphenol A, bisphenol Z, bisphenol S, biphenol, naphthalenediol, adamantanediol, adamantanedimethanol, hydrogenated bisphenol A and cyclohexanedimethanol are particularly preferred.

It is also preferred that the bisphenols above are an alkylene oxide adduct, and examples of the alkylene oxide group include an ethylene oxide group, a propylene oxide group and a butylene oxide group, with ethylene oxide and propylene oxide being preferred.

Among these, the noncrystalline polyester resin preferably contains a noncrystalline polyester resin polymerized using a polycondensable monomer having an aromatic group. That is, the noncrystalline polyester resin is preferably a noncrystalline polyester resin obtained by polycondensing a polyol having an aromatic group and/or a polycarboxylic acid having an aromatic group, more preferably a noncrystalline polyester resin obtained by polycondensing a diol having an aromatic group and/or a dicarboxylic acid having an aromatic group, still more preferably a noncrystalline polyester resin obtained by polycondensing a diol having an aromatic group.

The aromatic group is not particularly limited and may be sufficient if it contains an aromatic group such as phenyl group, naphthyl group and anthracenyl group in its structure. Among these, those having a bisphenol structure are preferred. A noncrystalline polyester obtained by polycondensing a polyol having a bisphenol structure and/or a polycarboxylic acid having a bisphenol structure is more preferred, a polyester obtained using a polyol having a bisphenol structure is still more preferred, and a polyester produced using a diol having a bisphenol structure is yet still more preferred.

The bisphenol structure is not particularly limited as long as it is a structure constituted by two phenol groups, and examples thereof include, but are not limited to, bisphenol A, bisphenol C, bisphenol E, bisphenol F, bisphenol M, bisphenol P, bisphenol S and bisphenol Z. Preferred examples of the structure include bisphenol A, bisphenol C, bisphenol E, bisphenol F, bisphenol M, bisphenol P, bisphenol S and bisphenol Z. Among these, Bisphenol A, bisphenol E and bisphenol F are more preferred, and bisphenol A is still more preferred. That is, the noncrystalline polyester resin is preferably a noncrystalline polyester resin polymerized using a polycondensable monomer having a bisphenol A structure.

The polycondensable monomer used for obtaining a noncrystalline polyester resin having a bisphenol structure is preferably a polyol having a bisphenol structure, more preferably bisphenol or an alkylene oxide adduct of bisphenol.

Examples of the alkylene oxide include an alkylene oxide having a carbon number of 1 to 6, such as ethylene oxide, propylene oxide and butylene oxide. Among these, ethylene oxide and propylene oxide are preferred.

Above all, the polyol used for obtaining a noncrystalline polyester is preferably an alkylene oxide adduct of bisphenol A, more preferably an ethylene oxide adduct or propylene oxide adduct of bisphenol A. The alkylene oxide is preferably added in 2 to 4 mol, more preferably in 2 or 4 mol, in terms of both ends (total molar number). Within this range, the viscoelasticity or glass transition of the polyester is appropriately controlled for use as a toner, which is preferred.

The noncrystalline polyester resin polymerized using a polycondensable monomer having an aromatic group is preferably contained in an amount of 30 to 100 wt %, more preferably from 50 to 100 wt %, still more preferably from 70 to 100 wt %, based on the entire noncrystalline polyester resin.

The noncrystalline polyester resin polymerized using a polycondensable monomer having an aromatic group preferably contains a monomer unit having an aromatic group in an amount of 30 mol % or more, more preferably 40 mol % or more, based on total monomer units of a monomer unit derived from a polyol and a monomer unit derived from a polycarboxylic acid.

The noncrystalline polyester resin is preferably a polyester resin obtained by reacting an ethylene oxide adduct and/or propylene oxide adduct of bisphenol A with terephthalic acid, and it is also preferred that at least one polycarboxylic acid selected from fumaric acid, dodecenylsuccinic acid and trimellitic anhydride is used as a polycarboxylic acid component in combination.

One kind of the polycarboxylic acid and one kind of the polyol may be used for producing one kind of a polyester resin (crystalline polyester resin or noncrystalline polyester resin), one kind may be used for one member while using two or more kinds for another member, or two or more kinds may be used for respective members. Also, in the case of using a hydroxycarboxylic acid for producing a polycondensed resin, one kind may be used alone, two or more kinds may be used, or a polycarboxylic acid or a polyol may be used in combination.

In this exemplary embodiment, the crystal melting temperature Tm of the crystalline polyester resin is preferably from 50 to 100° C. or about 50 to about 100° C., more preferably from 50 to 90° C. or about 50 to about 90° C., still more preferably from 50 to 80° C. or about 50 to about 80° C. The crystal melting temperature of the crystalline polyester resin is preferably in this range, because the separability and low-temperature fixability are excellent and furthermore, the offset can be reduced.

Here, the melting temperature of the crystalline polyester resin can be measured using a differential scanning calorimeter and determined as a melting peak temperature of the input compensation differential scanning calorimetry prescribed in JIS K-7121:87 when the measurement is performed at a temperature rising rate of 10° C./min from room temperature (20° C.) to 180° C. The crystalline polyester resin sometimes shows a plurality of melting peaks but in this exemplary embodiment, the maximum peak is regarded as the melting temperature.

The glass transition temperature (Tg) of the noncrystalline polyester resin is preferably 30° C. or more, more preferably from 30 to 100° C., still more preferably from 50 to 80° C.

Within this numeric range, the resin during use is in a glass state and therefore, the toner particles are kept from aggregating due to heat or pressure imposed at the image formation and in turn from adhering/depositing in the machine, so that a stable image forming ability can be obtained for a long period of time.

The glass transition temperature of the noncrystalline polyester resin indicates a value measured by the method prescribed in ASTM D3418-82 (DSC method).

Also, in this exemplary embodiment, the measurement of the glass transition temperature can be performed according to the differential scanning calorimetry by using, for example, "DSC-20" (manufactured by Seiko Instruments & Electronics Ltd.). More specifically, about 10 mg of a sample is heated at a constant temperature rising rate (10° C./min) and the glass transition temperature is determined from the intersection point between the base line and the inclined line of the endothermic peak.

Assuming that the glass transition temperature of the noncrystalline polyester contained in the later-described colored toner is Tg(A) (° C.) and the glass transition temperature of the noncrystalline polyester resin contained in the transparent toner is Tg(B), these preferably satisfy $Tg(B)-Tg(A) \geqq 2°$ C. The difference between the glass transition temperature of the noncrystalline polyester contained in the colored toner and the glass transition temperature of the noncrystalline polyester resin contained in the transparent toner is preferably in the range above, because good melting is obtained by the quantity of heat applied from a fixing device and generation of gloss unevenness is suppressed. Incidentally, when the image area and the non-image area are compared, the image area is larger in the total toner amount and is preferably more likely to melt.

The difference $Tg(B)-Tg(A)$ is more preferably from 2 to 10° C. or about 2 to about 10° C., still more preferably from 2 to 8° C. or about 2 to about 8° C., yet still more preferably from 2 to 5° C. or about 2 to about 5° C.

Here, in the case where the colored toner and/or the transparent toner contain two or more kinds of noncrystalline polyester resins, Tg(B) and Tg(A) each is the glass transition temperature of a noncrystalline polyester resin of which content is largest.

The weight average molecular weight of the crystalline polyester resin is preferably from 10,000 to 60,000 or about 10,000 to about 60,000, more preferably from 15,000 to 45,000 or about 15,000 to about 45,000, still more preferably from 20,000 to 30,000 or about 20,000 to about 30,000.

The weight average molecular weight of the noncrystalline polyester resin is preferably from 5,000 to 100,000 or about 5,000 to about 100,000, more preferably from 10,000 to 90,000 or about 10,000 to about 90,000, still more preferably from 20,000 to 80,000 or about 20,000 to about 80,000.

The weight average molecular weight of each of the crystalline polyester resin and the noncrystalline polyester resin is preferably in the numeric range above, because both image strength and fixability can be satisfied. The weight average molecular weight above is obtained by measuring the molecular weight of a tetrahydrofuran (THF) soluble portion by gel permeation chromatography (GPC). The molecular weight of the resin is determined by measuring a THF soluble material in a THF solvent with use of TSK-GEL (GMH (produced by Tosoh Corp.)) or the like and calculating the molecular weight based on the molecular weight calibration curve produced from a monodisperse polystyrene standard sample.

The acid value of each of the crystalline polyester resin and the noncrystalline polyester resin is preferably from 1 to 50 mgKOH/g, more preferably from 5 to 50 mgKOH/g, still more preferably from 8 to 50 mgKOH/g.

The acid value is preferably in the range above, because the fixing characteristics and charging stability are excellent.

In this exemplary embodiment, a polymerization reaction of the above-described polycarboxylic acid and polyol as polycondensation monomers with a previously produced oligomer and/or prepolymer may be included as a polycondensation step. The prepolymer is not limited as long as it is a polymer capable of being melted or uniformly mixed in the monomers above.

Furthermore, in this exemplary embodiment, as long as crystalline and noncrystalline polyester resins are contained, the binder resin may be a homopolymer of the polycondensation component described above, a copolymer combining two or more kinds of monomers containing the polycondensation component above, or a mixture or graft polymer thereof, or may have a partially branched or crosslinked structure or the like.

In this exemplary embodiment, assuming that the amount of a monomer unit derived from a polyvalent carboxylic acid having a sulfonic acid group in the crystalline polyester resin contained in the transparent toner is (a) mol % and the ratio (weight ratio) of the crystalline polyester resin to the total amount of the crystalline polyester resin and noncrystalline polyester resin of the transparent toner is (b), (a)×(b) is preferably 4 mol % or less or about 4 mol % or less.

The sulfonic group is a strong acid and therefore, has high hydrophilicity and in the chemical production method of producing a toner in water, the sulfonic acid group is liable to be present on the toner surface. When (a)×(b) is 4 mol % or less, a good shape distribution is obtained and this is preferred.

(a)×(b) is preferably from 0 to 4 mol % or about 0 to about 4 mol %, more preferably from 0 to 3 mol % or about 0 to about 3 mol %, still more preferably from 0 to 2 mol % or about 0 to about 2 mol %.

In this exemplary embodiment, the content of the sulfonic acid group in the binder resin of the transparent toner is preferably smaller. The sulfonic acid group is, in many cases, derived from the polyvalent carboxylic acid having a sulfonic acid group in the crystalline polyester resin and therefore, by specifying (a)×(b), a polyester resin reduced in the sulfonic acid group content can be obtained.

The amount of the monomer unit derived from the polyvalent carboxylic acid having a sulfonic acid group is measured by the following method.

The sulfonic acid (salt)-containing monomer in the crystalline polyester resin is quantitatively determined as follows by using a nuclear magnetic resonator ($^1$H-NMR).

A measurement sample is prepared by dissolving 30 mg of a sample in 0.7 mL of a deuterated chloroform solution and adding thereto tetramethylsilane (TMS) as a reference material in a concentration of 0.05 vol %. A 5 mm-diameter glass tube for NMR measurement is used for the sample tube. The measurement is performed using a nuclear magnetic resonator JNM-AL400 (manufactured by JEOL Ltd.) at a temperature of 23 to 25° C. under the condition of a cumulated number of 1,000 times.

From the analysis results of the obtained spectrum, the structure verification and the calculation of compositional ratio by integral ratio are performed.

Also, the ratio between the crystalline polyester resin and the noncrystalline polyester resin is measured by the following method. That is, the resin components are isolated by preparative chromatography and determined for respective proportions. Whether the resin is a crystalline polyester resin or a noncrystalline polyester resin is judged by DSC.

In order to obtain a crystalline polyester where (a)×(b) is 4 mol % or less, the amount used of the polyvalent carboxylic acid containing a sulfonic acid group is preferably limited. More specifically, the amount used of the polyvalent carboxylic acid containing a sulfonic acid group is preferably 3 mol % or less, more preferably 2.5 mol % or less, still more preferably 2 mol % of less, based on the entire polycondensable monomer including the polyvalent carboxylic acid and the polyhydric alcohol.

Here, the sulfonic acid group may form a salt and the total amount of a sulfonic acid group and a sulfonate group is preferably in the range above.

The crystalline polyester resin and the noncrystalline polyester resin can be produced by performing a condensation reaction of the polyhydric alcohol with the polyvalent carboxylic acid in a usual manner. For example, the polyhydric alcohol, the polyvalent carboxylic acid and, if desired, a catalyst are charged and blended in a reaction vessel equipped with a thermometer, a stirrer and a falling-type condenser, the blend is heated at 150 to 250° C. in the presence of an inert gas (e.g., nitrogen gas), low molecular compounds as by-products are continuously removed out of the reaction system, the reaction is stopped at the time of reaching a predetermined acid value, and after cooling, the objective reaction product is obtained, whereby the resin can be produced.

Examples of the catalyst used for the synthesis of the polyester resin include an esterification catalyst such as organic metal (e.g., dibutyltin dilaurate, dibutyltin oxide) and a metal alkoxide (e.g., tetrabutyl titanate). The amount added of the catalyst is preferably from 0.01 to 1 wt % based on the total amount of raw materials.

[Other Binder Resins]

In this exemplary embodiment, a conventionally known thermoplastic binder resin or the like may be used as the binder resin together with the above-descried crystalline polyester resin or noncrystalline polyester resin or by itself. Specific examples thereof include a homopolymer or copolymer (styrene-based resin) of styrenes such as styrene, parachlorostyrene and α-methylstyrene; a homopolymer or copolymer ((meth)acrylic acid ester-based resin) of esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; a homopolymer or copolymer (vinyl nitrile-based resin) of vinyl nitriles such as acrylonitrile and methacrylonitrile; a homopolymer or copolymer (vinyl ether-based resin) of vinyl ethers such as vinyl methyl ether and vinyl isobutyl ether; a homopolymer or copolymer (vinyl ketone-based resin) of vinyl ketones such as vinyl methyl ketone, vinyl ethyl ketone and vinyl isopropenyl ketone; a homopolymer or copolymer (olefin-based resin) of olefins such as ethylene, propylene, butadiene and isoprene; a non-vinyl condensate-based resin such as epoxy resin, polyurethane resin, polyamide resin, cellulose resin and polyether resin; and a graft polymer of the non-vinyl condensate-based resin and a vinyl-based monomer. One of these resins may be used alone, or two or more kinds thereof may be used in combination. Among these resins, the above-described various vinyl-based resins are preferred.

The vinyl-based resin is advantageous in that a resin particle liquid dispersion can be easily prepared by emulsion polymerization or seed polymerization using an ionic surfactant or the like. Examples of the vinyl-based monomer include monomers that are a raw material of a vinyl polymer acid or a vinyl polymer base, such as acrylic acid, methacrylic acid, maleic acid, cinnamic acid, fumaric acid, vinylsulfonic acid, ethyleneimine, vinylpyridine and vinylamine.

A styrene-based resin and a (meth)acrylic resin, particularly, a styrene(meth)acrylic copolymer resin, may be used as the noncrystalline resin for use in this exemplary embodiment.

A liquid dispersion obtained by polymerizing a monomer mixture composed of from 50 to 90 pats by weight of a vinyl aromatic monomer (styrene-based monomer), from 10 to 50 parts by weight of an ethylenically unsaturated carboxylic acid ester monomer ((meth)acrylic acid ester-based monomer), from 0 to 10 parts by weight of other monomers copolymerizable with these monomers, and from 1 to 3 parts by weight of an ethylenically unsaturated acid monomer, and dispersing and stabilizing the obtained copolymer with a surfactant is preferred as the noncrystalline resin component. The glass transition temperature of the copolymer is preferably from 50 to 70° C.

The polymerizable monomers constituting the above-described copolymer resin are described below.

Examples of the styrene-based monomer include styrene, α-methylstyrene, vinylnaphthalene, an alkyl-substituted styrene having an alkyl chain, such as 2-methyl styrene, 3-methylstyrene, 4-methylstyrene, 2-ethylstyrene, 3-ethylstyrene and 4-ethylstyrene, a halogen-substituted styrene such as 2-chlorostyrene, 3-ehlorostyrene and 4-chlorostyrene, and a fluorine-substituted styrene such as 4-fluorostyrene and 2,5-difluorostyrene. The styrene-based monomer is preferably styrene.

Examples of the (meth)acrylic acid ester-based monomer include n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth) acrylate, tert-butyl (meth)acrylate, isopentyl (meth)acrylate, amyl (meth)acrylate, neopentyl (meth)acrylate, isohexyl (meth)acrylate, isoheptyl (meth)acrylate, isooctyl (meth) acrylate, 2-ethylhexyl (meth)acrylate, phenyl (meth)acrylate, biphenyl (meth)acrylate, diphenylethyl (meth)acrylate, tert-butylphenyl (meth)acrylate, terphenyl (meth)acrylate, cyclohexyl (meth)acrylate, tert-butylcyclohexyl (meth)acrylate, dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth) acrylonitrile and (meth)acrylamide. The (meth)acrylic acid ester-based monomer is preferably n-butyl acrylate.

The ethylenically unsaturated acid monomer is an ethylenically unsaturated monomer containing an acid group such as carboxy group, sulfonic acid group and acid anhydride.

In the case of incorporating a carboxy group into the styrene-based resin, (meth)acrylic resin or styrene-(meth) acrylic copolymerization resin, this may be attained by copolymerizing a carboxy group-containing polymerizable monomer together.

Specific examples of the carboxy group-containing polymerizable monomer include acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid and methoxycinnamic acid. In view of easiness of the polymer-forming reaction, acrylic acid, methacrylic acid, maleic acid, cinnamic acid and fumaric acid are preferred, and acrylic acid is more preferred.

The binder resin for use in the transparent toner of this exemplary embodiment may use a chain transfer agent at the polymerization thereof. The chain transfer agent is not particularly limited, but examples thereof include a compound having a thiol component. Specific preferred examples thereof include alkyl mercaptans such as hexyl mercaptan, heptyl mercaptan, octyl mercaptan, nonyl mercaptan, decyl mercaptan and dodecyl mercaptan. These are preferred in that the molecular weight distribution becomes narrow and in turn, good storability of the toner at high temperatures is obtained.

The concentration of a dissociable group in the ethylenically unsaturated monomer is determined, for example, by the method described in Soichi Muroi, Kobunshi Latex no Kagaku (Chemistry of Polymer Latex), Koburthsi Kanko Kai (1970), where a polymer such as toner particle is dissolved from the surface and quantitatively determined. Incidentally, by this method or the like, the molecular weight or glass transition temperature of a resin from the surface to the inside of a particle is also determined.

<Release Agent>

In the transparent toner and the later-described colored toner of this exemplary embodiment, a release agent may be added, if desired. The release agent is generally used for enhancing the releasability, but for suppressing low charging particularly in the summer environment, a release agent having a polar group is preferably used. Thanks to the presence of a polar group, interaction with a water molecule and in turn, low charging in the summer environment can be suppressed. Specific examples of the release agent include low molecular weight polyolefins such as polyethylene, polypropylene and polybutene; silicones having a softening temperature under heating; fatty acid amides such as oleic acid amide, erucic acid amide, ricinoleic acid amide and stearic acid amide; vegetable waxes such as carnauba wax, rice wax, candelilla wax, haze wax and jojoba oil; animal waxes such as bees wax; mineral or petroleum waxes such as montan wax, ozokerite, ceresin, paraffin wax, microcrystalline wax and Fischer-Tropsch wax; and ester-based waxes such as fatty acid ester, montanic acid ester and carboxylic acid ester. Among these, vegetable waxes such as carnauba wax, rice wax, candelilla wax, haze wax and jojoba oil; animal waxes such as bees wax; and ester-based waxes such as fatty acid ester, montanic acid ester and carboxylic acid ester are preferred because of the above-described reason.

In this exemplary embodiment, one of these release agents may be used alone, or two or more kinds thereof may be used in combination.

The amount of the release agent added is preferably from 1 to 20 wt % or about 1 to about 20 wt %, more preferably from 5 to 15 wt % or about 5 to about 15 wt %, based on the entire amount of the transparent toner or colored toner particles. Within this range, sufficiently high effect of the release agent is obtained and the toner particle is not easily broken in the inside of the developing machine, as a result, the release agent is not spent to the carrier and the electrostatic charge is hardly lowered.

<Internal Additive>

In the transparent toner and the later-described colored toner of this exemplary embodiment, an internal additive may be added to the inside of the toner.

The internal additive is generally used for the purpose of controlling viscoelasticity of the fixed image. Specific examples of the internal additive include an inorganic particle such as silica and titania, and an organic particle such as polymethyl methacrylate. The internal additive may be surface-treated for enhancing the dispersibility. One of these internal additives may be used alone, or two or more kinds thereof may be used in combination.

<External Additive>

In the transparent toner and the later-described colored toner of this exemplary embodiment, an external additive such as fluidizing agent and charge controlling agent may be externally added.

As for the external additive, a known material may be used, and examples thereof include an inorganic particle surface-treated with a silane coupling agent or the like, such as silica particle, titanium oxide particle, alumina particle, cerium oxide particle and carbon black, a polymer particle such as polycarbonate, polymethyl methacrylate and silicone resin, an amine metal salt, and a salicylic acid metal complex. One of these external additives may be used alone, or two or more kinds thereof may be used in combination.

The external additive which can be used in this exemplary embodiment is preferably an oxide containing a nitrogen atom, more preferably a silica particle containing a nitrogen atom. When the external additive is an oxide containing a nitrogen atom, the performance in terms of fogging at the change in the temperature and humidity environment, particularly at the change from a low-temperature low-humidity environment to a high-temperature high-humidity environment, and the image density are excellent.

Examples of the silica particle containing a nitrogen atom include a silica particle of which surface is treated with an aminosilane coupling agent.

<Charge Controlling Agent>

In the transparent toner and the later-described colored toner of this exemplary embodiment, a charge controlling agent may be added, if desired.

As for the charge controlling agent, a known material may be used, but a halide of quaternary ammonium group-containing alkyl(phenyl) compound, or a polar group-containing resin-type charge controlling agent can be used. In the case of producing the toner by a wet production process, a material hardly soluble in water is preferably used in view of control of ion intensity and reduction of waste water pollution. Incidentally, the transparent toner and the later-described colored toner of this exemplary embodiment may be either a magnetic toner containing a magnetic material by itself or a nonmagnetic toner containing no magnetic material.

(Colored Toner)

The colored toner contains a coloring agent, a binder resin and, if desired, other components such as release agent, internal additive and external additive.

The toner set for electrostatic image development of this exemplary embodiment contains at least one kind of a colored toner and preferably contains a plurality of colored toners.

More specifically, the colored toner is preferably composed of at least a cyan toner for developing a cyan color, a magenta toner for developing a magenta color, and a yellow toner for developing a yellow color. Also, a black toner for developing a black color is preferably contained, if desired.

<$D_{50V}$, GSDv, GSDp>

In the colored toner, the preferred ranges of $D_{50V}$, GSDv and GSDp and the reasons therefor are the same as in the transparent toner.

Also, the measuring method for the volume average particle diameter $D_{50V}$, the number average particle size distribution index (GSDp), the volume average particle size distribution index (GSDv) and the like are as described above.

<Coloring Agent>

In this exemplary embodiment, the colored toner contains a coloring agent.

The coloring agent which can be used in this exemplary embodiment is not particularly limited, and a general dye or pigment can be used. However, some dyes are water-soluble and in the case of having a step of producing a toner in water as in this exemplary embodiment, a pigment is preferred.

More specifically, examples of the yellow coloring agent include a monoazo-based pigment such as C.I. Pigment Yellow 74 and C.I. Pigment Yellow 1, 2, 3, 5, 6, 49, 65, 73, 75, 97, 98, 111, 116 and 130; a benzimidazolone-based pigment such as C.I. Pigment Yellow 154 and C.I. Pigment Yellow 120, 151, 175, 180, 181 and 194; a disazo condensation-type pigment such as C.I. Pigment Yellow 93 and C.I. Pigment Yellow 94, 95, 128 and 166; an isoindolinone-based pigment such as C.I. Pigment Yellow 110 and C.I. Pigment Yellow 109; an anthraquinone-based pigment such as C.I. Pigment Yellow 147 and C.I. Pigment Yellow 24, 108, 193 and 199; a disazo-based pigment such as C.I. Pigment Yellow 12, 13, 14, 17, 55, 63, 81, 83, 87, 90, 106, 113, 114, 121, 124, 126, 127, 136, 152, 170, 171, 172, 174, 176 and 188; an azo lake pigment such as C.I. Pigment Yellow 61, 62, 133, 168 and 169; an isoindolinone-based pigment such as C.I. Pigment Yellow 139; and a quinophthalone-based pigment such as C.I. Pigment Yellow 138.

Examples of the magenta coloring agent include a β-naphthol-based pigment such as C.I. Pigment Red 146 and C.I. Pigment Red 2, 5, 7, 8, 9, 10, 11, 12, 13, 14, 15, 16, 17, 18, 21, 22, 23, 31, 32, 95, 112, 114, 119, 136, 147, 148, 150, 164, 170, 184, 187, 188, 210, 212, 213, 222, 223, 238, 245, 253, 256, 258, 261, 266, 267, 268 and 269; an azo lake-based pigment such as C.I. Pigment Red 57:1 and C.I. Pigment Red 18:1, 48:2, 48:3, 48:4, 48:5, 50:1, 51, 52:1, 52:2, 53:1, 53:2, 53:3, 58:2, 58:4, 64:1, 68 and 200; a quinacridone-based pigment such as C.I. Pigment Red 209, C.I. Pigment Red 122, 192, 202 and 207, and C.I. Pigment Violet 19; a disazo-based pigment such as C.I. Pigment Red 37, 38, 41 and 111, and C.I. Pigment Orange 13, 15, 16, 34 and 44; a benzimidazolone-based pigment such as C.I. Pigment Red 171, 175, 176, 185 and 208, C.I. Pigment Violet 32, and C.I. Pigment Orange 36, 60, 62 and 72; a disazo condensation-type pigment such as C.I. Pigment Red 144, 166, 214, 220, 221, 242, 248 and 262, and C.I. Pigment Orange 31; a dioxazine-based pigment such as C.I. Pigment Violet 23 and 37; and a diketopyrrolopyrrole-based pigment such as C.I. Pigment Red 254, 255, 264 and 272, and C.I. Pigment Orange 71 and 73.

Examples of the blue pigment include an organic coloring agent such as iron blue, cobalt blue, alkali blue lake, Victoria blue lake, fast sky blue, indanthrene blue BC, ultramarine blue, phthalocyanine blue and phthalocyanine green.

Examples of the black pigment include an organic coloring agent such as carbon black and aniline black.

Also, a green pigment such as chrome green, pigment green B, malachite green lake and final yellow green G, and a violet pigment such as manganese violet, fast violet B and methyl violet lake, may be used. As for the dye, various dyes such as basic, acidic, disperse and direct dyes may be used, and examples thereof include nigrosine, methylene blue, rose Bengal and quinoline yellow.

As for the dispersing method of the coloring agent, the coloring agent is dispersed in an aqueous medium together with a dispersant such as surfactant by applying a mechanical impact or the like to produce a coloring agent liquid dispersion, and the coloring agent liquid dispersion is aggregated together with the binder resin particle and like and granulated to the toner particle diameter, whereby the toner can be obtained.

Specific examples of the technique for dispersing the coloring agent by a mechanical impact or the like include a media-type disperser such as rotation shearing homogenizer, ball mill, sand mill and attritor, and a high-pressure counter collision-type disperser. The liquid dispersion of the coloring agent particle can be prepared by using such a disperser. The coloring agent can also be dispersed in an aqueous medium by means of a homogenizer by using a surfactant having polarity.

In order to ensure the color formation at fixing, the coloring agent is preferably added in an amount of 4 to 15 wt %, more preferably from 4 to 10 wt %, based on the total weight of solid contents in the colored toner. However, in the case of using a magnetic material as the black coloring agent, the coloring agent is preferably added in an amount of 12 to 48 wt %, more preferably from 15 to 40 wt %. A toner of each color, such as yellow toner, magenta toner, cyan toner, black toner, white toner and green toner, can be obtained by appropriately selecting the kind of the coloring agent.

<Binder Resin>

The colored toner preferably contains, as the binder resin, a noncrystalline polyester resin. The noncrystalline polyester resin preferably contained in the colored toner is preferably a noncrystalline polyester resin polymerized using a polycondensable monomer having an aromatic group.

In the colored toner, the amount of the noncrystalline polyester resin contained in the binder resin is preferably from 80 to 100 wt %, more preferably from 90 to 100 wt %, still more preferably from 95 to 100 wt %, based on the entire binder resin. The content of the noncrystalline polyester resin in the binder resin is preferably in this range, because toner breakage due to agitation of the carrier is scarcely generated in the developing machine.

In the colored toner, the amount of the crystalline polyester resin contained in the binder resin is preferably 3 wt % or less or about 3 wt % or less, more preferably 2 wt % or less or about 2 wt % or less, based on the entire binder resin, and it is still more preferred to contain no crystalline polyester resin. The content of the crystal polyester in the binder resin of the colored toner is preferably in the range above, because the debris of the toner broken by the agitation of the toner and the carrier scarcely adheres to the carrier surface.

Incidentally, the colored toner may use, as the binder, other resins instead of the noncrystalline polyester resin and the crystalline polyester resin.

Examples of the noncrystalline polyester resin contained in the binder resin of the colored toner are the same as those of the noncrystalline polyester resin described above for the binder resin of the transparent toner, and the noncrystalline polyester resin polymerized using a polycondensable monomer having an aromatic group, which is a preferred exemplary embodiment, is also as described above.

(Production Method of Transparent Toner and Colored Toner)

The production method of the transparent toner mother particle and colored toner mother particle for use in this exemplary embodiment includes, for example, a kneading pulverization method, an emulsion polymerization aggregation method and suspension polymerization method and is not particularly limited, but an aggregation-coalescence method is preferred. A toner mother particle excellent in the particle diameter distribution and particle shape can be advantageously obtained by the aggregation-coalescence method.

<Kneading Pulverization Method>

The kneading pulverization method is a method of kneading a binder resin and if desired, a coloring agent, a release agent, a charge controlling agent and the like, and pulverizing and classifying the kneaded product. Also, for example, a method of applying a mechanical impact force or a heat energy to change the shape of the particle obtained by the kneading pulverization method may be employed.

<Aggregation-Coalescence Method>

In this exemplary embodiment, the production method of the transparent toner and the colored toner is preferably an aggregation-coalescence method.

The aggregation-coalescence method preferably contains a step of mixing, for example, a resin particle liquid dispersion in which resin particles having a particle diameter of 1 μm or less are dispersed, and, if desired, a coloring agent liquid dispersion in which a coloring agent is dispersed, and aggregating the resin particle and, if desired, the coloring agent and the like to a toner particle diameter (hereinafter, sometimes referred to as an "aggregating step"). Also, the aggregation-coalescence method preferably contains a step of heating the aggregated particle after the aggregating step at a temperature of not lower than the glass transition temperature of the resin particle or not lower than the melting temperature of the resin particle, thereby fusing the aggregate and forming a toner particle (hereinafter sometimes referred to as a "fusing step").

In the aggregating step, respective particles in the resin particle liquid dispersion and, if desired, the coloring agent liquid dispersion and the release agent liquid dispersion, which are mixed with each other, are aggregated to form an aggregated particle having a toner particle diameter. The aggregated particle is formed by hetero-aggregation or the like, and an ionic surfactant or a compound having a monovalent or greater electric charge, such as metal salt, may be added for the purpose of stabilizing the aggregated particle or controlling the particle size/particle size distribution.

The "toner particle diameter" as used herein indicates the above-described volume average particle diameter of the toner.

In the fusing step, the rein particle in the aggregated particle is melted under the temperature condition not lower than the glass transition point of the resin, and the aggregated particle changes from amorphous to spherical. Thereafter, the aggregate is separated from the aqueous medium and, if desired, washed and dried, whereby a toner particle is formed.

[Surfactant]

In the production of the toner of this exemplary embodiment, a surfactant can be used for the purpose of, for example, stabilizing the dispersion in the suspension polymerization method or stabilizing the dispersion of the resin particle liquid dispersion, coloring agent liquid dispersion and release agent liquid dispersion in the aggregation-coalescence method.

Examples of the surfactant include an anionic surfactant such as sulfate salt type, sulfonate salt type, phosphoric acid ester type and soap type; a cationic surfactant such as amine salt type and quaternary ammonium salt type; and a nonionic surfactant such as polyethylene glycol type, alkylphenol ethylene oxide adduct type and polyhydric alcohol type. Among these, an ionic surfactant is preferred, and an anionic surfactant and a cationic surfactant are more preferred.

In the transparent toner and the colored toner, an anionic surfactant is generally has a large dispersing power and ensures excellent dispersion of the resin particle and the coloring agent. Also, an anionic surfactant is advantageously used as the surfactant for dispersing the release agent.

The nonionic surfactant is preferably used in combination with the anionic surfactant or cationic surfactant. One of the surfactants described above may be used alone, or two or more kinds thereof may be used in combination.

Specific examples of the anionic surfactant include fatty acid soaps such as potassium laurate, sodium oleate and sodium caster oil; sulfuric acid esters such as octyl sulfate, lauryl sulfate, lauryl ether sulfate and nonylphenyl ether sulfate; sodium alkylnaphthalenesulfonates such as lauryl sulfonate, dodecylbenzene sulfonate, triisopropylnaphthalene sulfonate and dibutylnaphthalene sulfonate; sulfonates such as naphthalene sulfonate formalin condensate, monooctyl sulfosuccinate, dioctyl sulfosuccinate, lauric acid amide sulfonate and oleic acid amide sulfonate; phosphoric acid esters such as lauryl phosphate, isopropyl phosphate and nonylphenyl ether phosphate; dialkyl sulfosuccinates such as sodium dioctylsulfosuccinate; and sulfosuccinates such as disodium lauryl sulfosuccinate.

Specific examples of the cationic surfactant include amine salts such as laurylamine hydrochloride, stearylamine hydrochloride, oleylamine acetate, stearylamine acetate and stearylaminopropylamine acetate; and quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxyethylenemethylammonium chloride, lauloylaminopropyldimethylethylammonium ethosulfate, lauroylaminopro pyldimethylhydroxyethylammonium perchlorate, alkylbenzenetrimethylammonium chloride and alkyltrimethylammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkylphenyl ethers such as polyoxyethylene octylphenyl ether and polyoxyethylene nonylphenyl ether; alkyl esters such as polyoxyethylene laurate, polyoxyethylene stearate and polyoxyethylene oleate; alkylamines such as polyoxyethylene laurylamino ether, polyoxyethylene stearylamino ether, polyoxyethylene oleylamino ether, polyoxyethylene soybean amino ether and polyoxyethylene tallow amino ether; alkylamides such as polyoxyethylene lauric acid amide, polyoxyethylene stearic acid amide and polyoxyethylene oleic acid amide; vegetable oil ethers such as polyoxyethylene castor oil ether and polyoxyethylene rape seed oil ether; alkanolamides such as lauric acid diethanolamide, stearic acid diethanolamide and oleic acid diethanolamide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The content of the surfactant in each liquid dispersion is sufficient if it is small enough not to impair this exemplary embodiment, and is generally a small amount. Specifically, the surfactant content is from 0.01 to 3 wt %, preferably from 0.05 to 2 wt %, more preferably from 0.1 to 1 wt %. When the content is in this range, each liquid dispersion such as resin particle liquid dispersion, coloring agent liquid dispersion and release agent liquid dispersion is stable, causes no aggregation or isolation of a specific particle and does not affect the amount of the copper compound added, and the effect of this exemplary embodiment can be sufficiently obtained. In general, the dispersion of suspension polymerization toner having a large particle diameter is stable even when the amount of the surfactant used is small.

[Aggregating Agent]

In the case of using an aggregation-coalescence method for the production of the transparent toner and colored toner of this exemplary embodiment, aggregation is generated by changing the pH or the like in the aggregating step so that a particle having a toner particle diameter and containing a binder resin and a coloring agent can be prepared. At the same time, an aggregating agent may be added so as to stably or quickly aggregate particles or obtain an aggregated particle having a narrower particle size distribution.

The aggregating agent is preferably a compound having a monovalent or greater electric charge, and specific examples of the compound include water-soluble surfactants such as ionic surfactant and nonionic surfactant described above; acids such as hydrochloric acid, sulfuric acid, nitric acid, acetic acid and oxalic acid; metal salts of an inorganic acid, such as magnesium chloride, sodium chloride, aluminum sulfate, calcium sulfate, ammonium sulfate, aluminum nitrate, silver nitrate, copper sulfate and sodium carbonate; metal salts of an aliphatic acid or aromatic acid, such as sodium acetate, potassium formate, sodium oxalate, sodium phthalate and potassium salicylate; and metal salts of phenols, such as sodium phenolate.

Considering the stability of aggregated particle and the stability of aggregating agent against heat and aging as well as its removal at washing, the aggregating agent is preferably a metal salt of an inorganic acid in view of performance and usage. Specific examples thereof include metal salts of an inorganic acid, such as magnesium chloride, sodium chloride, aluminum sulfate, calcium sulfate, aluminum nitrate, silver nitrate, copper sulfate and sodium carbonate.

The amount of the aggregating agent added varies depending on the valence of electric charge but is preferably small for any valence and is preferably 3 wt % or less for a monovalent electric charge, 1 wt % or less for a divalent electric charge, and 0.5 wt % or less for a trivalent electric charge. The amount of the aggregating agent is preferably smaller and therefore, a compound having a higher valence is preferably used.

(Electrostatic Image Developer)

In this exemplary embodiment, the transparent toner and the colored toner can be used as a transparent electrostatic image developer (transparent developer) and a colored electrostatic image developer (colored developer), respectively. In this exemplary embodiment, the transparent developer and the colored developer are not particularly limited except for containing the transparent toner and the colored toner, respectively, and can take an appropriate composition of components according to the purpose. The electrostatic image developing toner is prepared as a one-component electrostatic image developer when used alone, and is prepared as a two-component electrostatic image developer when used in combination with a carrier.

The carrier is preferably a carrier obtained by using ferrite, iron powder or the like as the core material and coating it with a resin.

The core material (carrier core material) used is not particularly limited, and examples thereof include a magnetic metal such as iron, steel, nickel and cobalt, a magnetic oxide such as ferrite and magnetite, and glass bead. From the standpoint of using a magnetic brush method, a magnetic carrier is preferred. The average particle diameter of the carrier core material is preferably from 3 to 10 times the average particle diameter of the toner.

Also, the shape factor SF1 of the carrier is preferably from 110 to 145, more preferably from 120 to 140. The shape factor is preferably in this range, because the carrier and the toner are in an appropriate contact state and the effect of triboelectric charge is more enhanced.

The shape factor SF1 of the carrier is a shape factor indicating the degree of unevenness on the particle surface and is calculated by the following formula.

$$SF1 = \frac{(ML)^2}{A} \times \frac{\pi}{4} \times 100.$$

In the formula, ML represents the maximum length of the particle, and A represents the projected area of the particle.

Specific examples of the method for measuring SF1 include a method where an optical micrograph of the carrier scattered on a slide glass is incorporated into an image analyzer through a video camera, the SF1 is calculated on 50 carrier particles, and an average value thereof is determined.

The resin that can be used as a coat resin or the like for the carrier is preferably an acrylic resin, a styrene-based resin, a hydrocarbon-based resin, a silicone resin, or a copolymer resin thereof. One of these resins that can be used for the carrier may be used alone, or two or more kinds thereof may be used in combination.

For the purpose of imparting positive chargeability to the toner, the carrier preferably contains a resin containing a fluorine atom and/or a silicon atom. By virtue of using a resin containing a fluorine atom and/or a silicon atom for the carrier, the carrier can be electrically charged more negatively over a long period of time. Also, the performance in terms of fogging at the change in the temperature and humidity environment, particularly at the change from a low-temperature low-humidity environment to a high-temperature high-humidity environment, and the image density are excellent.

The resin containing a fluorine atom and/or a silicon atom is preferably a resin obtained by replacing at least one hydrogen atom in an acrylic resin, a styrene-based resin, a hydrocarbon-based resin or a copolymerization resin thereof by a fluorine atom, and/or a silicone resin, more preferably the resin above with a hydrogen atom being replaced by a fluorine atom, which is obtained by polymerizing a polymerizable composition containing at least one polymerizable monomer having a fluorine atom, and/or a silicone resin, still more preferably a resin obtained by using at least a (meth)acrylic acid compound having a fluorine atom, and/or a silicone resin.

Specific examples of the polymerizable monomer having a fluorine atom include fluoromethyl (meth)acrylate, difluoromethyl (meth)acrylate, trifluoromethyl (meth)acrylate, trifluoromethylethyl (meth)acrylate, tetrafluoroethylmethyl (meth)acrylate, perfluoropropylethyl (meth)acrylate, perfluorobutylethyl (meth)acrylate, perfluorohexylethyl (meth) acrylate, perfluorooctylethyl (meth)acrylate and perfluorooctylmethyl (meth)acrylate.

Also, for the purpose of controlling the electrostatic charge, a resin particle, an inorganic particle or the like may be dispersed in the coat resin.

Examples of the method for forming the resin coat layer on the surface of the carrier core material include a dipping method of dipping the carrier core material powder in a coat layer-forming solution, a spray method of spraying a coat layer-forming solution on the surface of the carrier core material, a fluid bed method of spraying a coat layer-forming solution on the carrier core material floated by fluidizing air, a kneader-coater method of mixing the carrier core material and a coat layer-forming solution in a kneader-coater and then removing the solvent, and a powder coating method of mixing the particulated coat resin with the carrier core material at a temperature not lower than the melting temperature of the coat resin and then cooling the mixture to coat the resin. Among these, a kneader-coater method and a powder coating method are preferred.

The coverage of the resin coat formed by the method above is from 0.5 to 10 wt % based on the carrier core material. The mixing ratio (weight ratio) of the toner and the carrier is preferably toner/carrier=from 1/100 to 30/100, more preferably from 3/100 to 20/100.

(Image Forming Method and Image Forming Apparatus)

In the image forming method of this exemplary embodiment, after forming a color toner image on a recording medium surface by using a colored toner according to an electrophotographic process or at the same time of forming a color toner image on a recording medium surface, a transparent toner is transferred and fixed on the color toner image as well as in the periphery thereof, whereby the image is imparted with gloss. The image forming method of this exemplary embodiment is not particularly limited as long as the toner set for electrostatic image development of this invention is used, but preferably includes a latent image forming step of forming an electrostatic latent image on a latent image holding member, a development step of developing the electrostatic latent image formed on the latent image holding member by using the toner set for electrostatic image development of this exemplary embodiment held on a developer holding member, a transfer step of transferring the toner image formed on the latent image holding member onto a transfer-receiving material, and a fixing step of fixing the toner image transferred onto the transfer-receiving material.

That is, in this exemplary embodiment, the transparent toner is suitable as a transparent toner for imparting good gloss to the image by being transferred and fixed on a colored toner image (hereinafter sometimes referred to as a "color toner image") as well as in the periphery thereof, and in this case, the above-described image forming method preferably further includes a color toner image forming step of forming a color toner image on a latent image holding member surface, a transfer step of transferring the color toner image onto a transfer-receiving material surface, and a fixing step of fixing the color toner image transferred onto the transfer-receiving material surface. The latent image holding member on which a toner image is formed using the transparent toner, and the latent image holding member on which a colored toner image is formed, may be the same or different but are preferably different latent image holding members.

Also, the image forming apparatus of this exemplary embodiment is not particularly limited as long as the toner set for electrostatic image development of this exemplary embodiment is used, but preferably includes a latent image holding member, a charging unit for electrically charging the latent image holding member, an exposure unit for exposing the electrically charged latent image holding member to form an electrostatic latent image on the latent image holding member, a developing unit for developing the electrostatic latent image with a developer containing a toner to form a toner image, a transfer unit for transferring the toner image onto a transfer-receiving material from the latent image holding member, and a fixing unit for fixing the toner image, wherein the toner set for electrostatic image development of this exemplary embodiment is preferably used as the toner. The image forming apparatus more preferably includes a developing unit for developing a latent image holding member to form a color toner image and a transfer unit for transferring the color toner image to a transfer-receiving material from the latent image holding member.

The image forming apparatus is described below by referring to the drawing.

The drawing is a view showing the construction of an image forming unit 10 according to an exemplary embodiment. The image forming unit 10 is mounted, for example, in an image forming apparatus such as color printer, color copying machine or complex machine having a plurality of these functions. The image forming engines 100Y, 100M, 100C and 100K shown in the drawing perform image making by using the toners of yellow (Y) color, magenta (M) color, cyan (C) color and black (K) color, respectively. On the other hand, the image forming engine 100T forms a transparent toner layer by using a transparent toner. This transparent toner of which absorption factor in the visible light region (400 to 700 nm) is lower than a predetermined factor can be scarcely recognized with a human eye and is utilized mainly for imparting a glossy texture or a peculiar color tone to the image.

The constructions of the image forming engines 100Y, 100M, 100C, 100K and 100T are described in detail below. The image forming engine 100Y includes a photoreceptor drum (latent image holding member) 11Y that rotates in the arrow A direction, a charging device 12Y for uniformly charging the photoreceptor drum to a predetermined charge potential, an exposure device 13Y for irradiating the photoreceptor drum 11Y with light according to the image data of Y (yellow) to form an electrostatic latent image, a developing device 14Y for supplying a yellow toner to the electrostatic latent image to perform development and thereby form a toner image on the photoreceptor drum 11Y surface, a primary transfer device 15Y for primarily transferring the toner image onto an intermediate transfer belt 106, and a cleaning device 16Y for removing the toner remaining on the photoreceptor drum 11Y surface after the primary transfer. The constructions of the image forming engines 100M, 100C, 100K and 100T are the same as that of the image forming engine 100Y except that the color of the toner is different.

The intermediate transfer belt 106 is hung over a plurality of various rolls 108, 109, 110, 111 and 112 (intermediate transfer roll) and is orbitally moved in the arrow B direction by these rolls. On this intermediate transfer belt 106, the toner images formed by the image forming engines 100Y, 100M, 100C, 100K and 100T are primarily transferred and superposed in registration with each other. In the nip region formed between a secondary transfer roll 111 and an opposing roll 113, the toner image transferred onto the outer circumferential surface of the intermediate transfer belt 106 is transferred (secondary transfer) onto paper that is conveyed along the conveying path 114 from a paper feeding source (not shown). The fixing device 42 includes a fixing roll 42*a* and a pressure roll 42*b* opposing each other across the conveying path 114, where the paper having secondarily transferred thereon the toner image is rapidly heated while applying a pressure by the fixing roll 42*a* and the pressure roll 42*b*, whereby the toner image is fixed on the paper.

As regards the unit for forming a colored toner image or a transparent toner image on a recording medium surface, a conventionally known toner image forming apparatus by an electrophotographic system may be used. As long as the purpose of forming a color image on a recording medium surface is fulfilled, a toner image forming apparatus that is itself known may be used.

For example, the toner image forming apparatus preferably includes a photoreceptor (electrostatic latent image holding member), a charging device (charging unit) opposing the photoreceptor, an image signal forming device for controlling image signals to form a color image, an exposure device (exposure unit) for imagewise exposing the photoreceptor based on image signals from the image signal forming device to form a latent image, a developing device (developing unit) for developing the latent image on the photoreceptor surface by a developer layer containing a color toner, and a transfer device (transfer unit) for transferring the toner image formed on the photoreceptor surface, onto a recording medium.

A construction having an intermediate transfer material as described above, where the toner image on the photoreceptor is once transferred onto the intermediate transfer material and the toner image is then transferred onto a recording medium surface from the intermediate transfer material by a secondary transfer device, is also preferred.

The photoreceptor is not particularly limited and a conventionally known photoreceptor can be employed without any problem. The photoreceptor may be either a photoreceptor having a single-layer structure or a function-separated photoreceptor having a multilayer structure and in terms of the construction material, may be either an inorganic photoreceptor such as selenium or amorphous silicon or an inorganic photoreceptor (so-called OPC (Organic Photoconductor)).

As for the charging device, a unit that is itself is known, for example, a contact-type charging device using an electrically conductive or semi-conductive roller, brush, film or rubber blade, or a non-contact type charging device utilizing corona discharge, such as corotron charger or scorotron charger, may be used.

As for the exposure device, a conventionally known exposure unit, for example, a combination of a semiconductor laser and a scanning device, a laser ROS (Raster Output Scanner) composed of an optical system, or an LED head, may be used. In order to realize a preferred exemplary embodiment allowing the formation of a uniform exposure image with high resolution, a laser ROS or an LED head is preferred.

As for the image signal forming device, any conventionally known unit may be used as long as a signal for forming a toner image at a desired position on a recording medium surface can be generated.

As for the developing device, a conventionally known developing device can be used irrespective of one-component type or two-component type as long as it has a function of forming a uniform and high-resolution toner image for the latent image on the photoreceptor surface. In view of good graininess and capability of reproducing a smooth tone, a two-component type developing device is preferred.

As regards the transfer device, a conventionally known unit, for example, a unit where an electric field is created between the photoreceptor and the recording medium or intermediate transfer material by using an electrically conductive or semi-conductive roller, brush, film, rubber blade or the like applied with a voltage and the toner image composed of electrically charged toner particles is thereby transferred, or a unit where the back surface of the recording medium or intermediate transfer material is corona-charged by a corotron or scorotron charger utilizing corona discharge and the toner image composed of electrically charged toner particles is thereby transferred, may be used.

As for the intermediate transfer material, an insulating or semi-conductive belt material or a drum-shaped material having an insulating or semi-conductive surface may be used. A semi-conductive belt material is preferred because the transfer property can be stably maintained during continuous image formation and the device can be small-sized. With respect to such a belt material, a belt material composed of a resin material having dispersed therein an electrically conductive filler such as carbon fiber is known. The resin here is preferably, for example, a polyimide resin.

As for the secondary transfer device, a known unit, for example, a unit where an electric field is created between the intermediate transfer material and the recording medium by using an electrically conductive or semi-conductive roller, brush, film, rubber blade or the like applied with a voltage and the toner image composed of electrically charged toner particles is thereby transferred, or a unit where the back surface of the intermediate transfer material is corona-charged by a corotron or scorotron charger utilizing corona discharge and the toner image composed of electrically charged toner particles is thereby transferred, may be used.

By using the toner image forming apparatus described above, a color toner image can be formed on a recording medium surface.

In the foregoing pages, the image forming apparatus of this exemplary embodiment is described by referring to preferred examples, but this exemplary embodiment is not limited to those examples and as long as the construction of this exemplary embodiment is satisfied, the construction of this exemplary embodiment can be replaced by techniques based on conventionally known knowledge or newly discovered or invented for this exemplary embodiment.

EXAMPLES

This exemplary embodiment is described in greater detail below by referring to Examples, but this exemplary embodiment is not limited to these Examples.

In the following Examples and Comparative Examples, unless otherwise indicated, the "parts" means "parts by weight".

(Preparation of Noncrystalline Polyester Resin)

Into a reaction vessel equipped with a stirrer, a thermometer, a condenser and a nitrogen gas inlet tube, materials as an acid component (polyvalent carboxylic acids) and an alcohol component (polyhydric alcohols) are charged in a material compositional ratio (molar ratio) shown in the Table below. After replacing the inside of the reaction vessel with a dry nitrogen gas, 0.16 wt % of dibutyltin oxide is charged into the monomer components, and the reaction is allowed to proceed with stirring at about 195° C. for about 6 hours under nitrogen gas flow and further allowed to proceed with stirring for about 6.0 hours by raising the temperature to about 240° C. Thereafter, the pressure in the reaction vessel is reduced to 10.0 mmHg, and the reaction is allowed to proceed with stirring for about 0.5 hours under reduced pressure. In this way, pale yellow transparent Noncrystalline Polyester Resins 1 to 4 are obtained.

TABLE 1

| | Monomers Used in Noncrystalline Polyester Resin and Ratio by mol % | Tg of Noncrystalline Polyester Resin | Molecular Weight (Mw) |
|---|---|---|---|
| 1 | TPA/FA/DSA/TMA = 62/2/33/3<br>BisAEO/BisAPO = 10/90 | 57.8° C. | 48,000 |
| 2 | TPA/TMA = 95/5<br>PG/NPG = 90/10 | 58.5° C. | 30,000 |
| 3 | TPA/FA/DSA/TMA = 60/5/30/5<br>BisAEO/BisAPO = 50/50 | 55.7° C. | 46,000 |
| 4 | TPA/FA/DSA/TMA = 60/7/25/8<br>BisAEO/BisAPO = 50/50 | 55.1° C. | 50,000 |

Monomers used in Table 1 are as follows.
TPA: terephthalic acid
FA: fumaric acid
DSA: dodecenylsuccinic anhydride
TMA: trimellitic anhydride
BisAEO: bisphenol A ethylene oxide 2-mol adduct
BisAPO: bisphenol A propylene oxide 2-mol adduct
PG: propylene glycol
NPG: neopentyl glycol (Preparation of Noncrystalline Polyester Resin Liquid Dispersion)

500 Parts of noncrystalline resin is dissolved in 2,500 parts of ethyl acetate, a solution obtained by dissolving 20 parts of anionic surfactant Dowfax in 3,000 parts of ion-exchanged water is added, the resulting solution is stirred at 8,000 revolutions for 20 minutes by using Ultra-turrax, and ethyl acetate is removed by distillation to obtain a noncrystalline resin liquid dispersion. Thereafter, water content is removed by an evaporator to a solid content concentration of 30 wt % or more, and deionized water is then added to obtain Noncrystalline Polyester Resin Liquid Dispersions (1) to (4) having a solid content concentration of 30 wt %.

(Preparation of Crystalline Polyester Resin)

Into a reaction vessel equipped with a stirrer, a thermometer, a condenser and a nitrogen gas inlet tube, materials as an acid component (polyvalent carboxylic acids) and an alcohol component (polyhydric alcohols) are charged in a material compositional ratio (molar ratio) shown in the Table below. After replacing the inside of the reaction vessel with a dry nitrogen gas, 0.30 wt % of dibutyltin oxide is charged into the monomer components, and the reaction is allowed to proceed with stirring at about 180° C. for 5 hours under nitrogen gas flow and further allowed to proceed with stirring for about 2.0 hours by raising the temperature to about 230° C. Thereafter, the system is air-cooled and the reaction is stopped, whereby a crystalline polyester resin is synthesized.

TABLE 2

| | Monomers Used in Crystalline Polyester Resin and Ratio by mol % | Tm of Crystalline Polyester Resin | Molecular Weight (Mw) | Sulfonic Acid (Salt) Content (mol %) |
|---|---|---|---|---|
| 1 | 1,10-dodecane diacid/ 1,10-decanediol = 100/100 | 78° C. | 30,000 | 0 |
| 2 | SDSP/1,10-dodecane diacid/ 1,9-nonanediol = 0.4/49.8/49.8 | 70° C. | 25,000 | 0.4 |
| 3 | SDSP/1,10-dodecane diacid/ 1,9-nonanediol = 0.6/49.7/49.7 | 68° C. | 24,000 | 0.6 |
| 4 | SDSP/1,10-dodecane diacid/ 1,10-decanediol = 0.8/49.6/49.6 | 66° C. | 22,000 | 0.8 |

The component used in the Table above is as follows.
SDSP: sodium isophthalic acid dimethyl-5-sulfonate <Measurement of Sulfonic Acid (Salt) Group Content>

The sulfonic acid (salt)-containing monomer in the crystalline polyester resin is quantitatively determined as follows by using a nuclear magnetic resonator ($^1$H-NMR).

A measurement sample is prepared by dissolving 30 mg of a sample in 0.7 mL of a deuterated chloroform solution and adding thereto tetramethylsilane (TMS) as a reference material in a concentration of 0.05 vol %. A 5 mm-diameter glass tube for NMR measurement is used for the sample tube.

The measurement is performed using a nuclear magnetic resonator JNM-AL400 (manufactured by JEOL Ltd.) at a temperature of 23 to 25° C. under the condition of a cumulated number of 1,000 times.

From the analysis results of the obtained spectrum, the structure verification and the calculation of compositional ratio by integral ratio are performed.

(Preparation of Crystalline Polyester Resin Liquid Dispersion)

| | |
|---|---|
| Crystalline polyester resin | 90 parts by weight |
| Ionic surfactant NEOGEN RK (produced by Dai-Ichi Kogyo Seiyaku Co., Ltd.) | 1.8 parts by weight |
| Ion-exchanged water | 210 parts by weight |

These components are heated at 100° C. and thoroughly dispersed by Ultra-turrax T50 manufactured by IKA Works, Inc., and the resulting dispersion is subjected to a dispersion treatment for 1 hour in pressure ejection-type Gaulin Homogenizer to obtain a crystalline polyester resin liquid dispersion. Thereafter, the water content is removed by an evaporator to a solid content concentration of 30 wt % or more, and deionized water is then added to obtain a crystalline polyester resin liquid dispersion having a solid content concentration of 30 wt %.

(Preparation of Release Agent Liquid Dispersion)

The following composition is mixed and heated at 97° C. and the mixture is dispersed by a homogenizer (Ultra-turrax T50, manufactured by IKA Works, Inc.), then subjected to a dispersion treatment in a Gaulin homogenizer (manufactured by Meiwafosis Co., Ltd.) and further treated for microparticulation 20 times under the conditions of 105° C. and 550 kg/cm$^2$ to prepare a release agent particle liquid dispersion having a volume average particle diameter of 190 nm.

| | |
|---|---|
| Ester-based wax (WEP4, produced by NOF Corporation) | 88 parts |
| Anionic surfactant (NEOGEN SC, produced by Dai-Ichi Kogyo Seiyaku Co., Ltd.) | 2 parts |
| Ion-exchanged water | 210 parts |

(Preparation of Coloring Agent Liquid Dispersion)

<Preparation of Coloring Agent Liquid Dispersion (1)>

| | |
|---|---|
| C.I. Pigment Yellow 74 (monoazo-based pigment) (SEIKAFAST Yellow 2054, produced by Dainichiseika Color & Chemicals Mfg. Co., Ltd.) | 80 parts |
| Anionic surfactant (NEOGEN SC, produced by Dai-Ichi Kogyo Seiyaku Co., Ltd.) | 10 parts |
| Ion-exchanged water | 210 parts |

These components are mixed and dissolved and the resulting solution is dispersed using a homogenizer (Ultra-turrax, manufactured by IKA Works, Inc.) for 10 minutes to prepare Coloring Agent Liquid Dispersion (1).

<Preparation of Coloring Agent Liquid Dispersion (2)>

Coloring Agent Liquid Dispersion (2) is prepared in the same manner as Coloring Agent Liquid Dispersion (1) except for changing the coloring agent to C.I. Pigment Red 122 (quinacridone-based pigment, CHROMOFINE Magenta 6887, produced by Dainichiseika Color & Chemicals Mfg. Co., Ltd.).

<Preparation of Coloring Agent Liquid Dispersion (3)>

Coloring Agent Liquid Dispersion (3) is prepared in the same manner as Coloring Agent Liquid Dispersion (1) except for changing the coloring agent to C.I. Pigment Blue 15:3 (phthalocyanine-based pigment, CYANINE Blue 4937, produced by Dainichiseika Color & Chemicals Mfg. Co., Ltd.).

<Preparation of Coloring Agent Liquid Dispersion (4)>

Coloring Agent Liquid Dispersion (4) is prepared in the same manner as Coloring Agent Liquid Dispersion (1) except for changing the coloring agent to carbon black (R330, produced by CABOT).

(Production Method of Toner)

| | |
|---|---|
| Crystalline Polyester Resin Liquid Dispersion A | a parts by weight |
| Noncrystalline Polyester Resin Liquid Dispersion B | b parts by weight |
| Release agent liquid dispersion | c parts by weight |
| Coloring Agent Liquid Dispersion D | d parts by weight |
| An aqueous 10% aluminum sulfate solution | e parts by weight |
| Ion-exchanged water | f parts by weight |

The mixture of the composition above is charged into a round stainless steel-made flask, adjusted to a pH of (s) with nitric acid and then mixed/dispersed by Ultra-Turrax T50. Thereafter, the flask is heated to 48° C. over a heating oil bath while stirring the contents in the flask and after adjusting the pH to (t) with an aqueous sodium hydroxide solution at 48° C., held for (u) hours.

Subsequently, g parts by weight of Noncrystalline Polyester Resin Liquid Dispersion B adjusted to a pH of (v) with nitric acid is added.

After keeping the temperature at 48° C. for 3 hours, the pH is adjusted to 8 by adding sodium hydroxide. The temperature of the heating oil bath is then raised and kept at (w)° C., and fusion/coalescence is performed for (x) hours. Immediately after stopping the stirring, the solution in the flack is rapidly cooled utilizing a heat exchanger. Subsequently, the solution in the flask after cooling is filtered, thoroughly washed with ion-exchanged water and dried to obtain a toner.

Transparent Toners 1 to 8 and Colored Toners 1 to 3 are obtained by the method above.

TABLE 3

| | | Crystalline Polyester Resin Liquid Dispersion A | | Noncrystalline Polyester Resin Liquid Dispersion B | | Release Agent Liquid Dispersion | Coloring Agent Liquid Dispersion D | | Aqueous 10% aluminum |
|---|---|---|---|---|---|---|---|---|---|
| | | kind | a parts by weight | kind | b parts by weight | c parts by weight | kind | d parts by weight | Sulfate Solution e parts by weight |
| Transparent Toner | 1 | Liquid Dispersion 1 | 9 | Liquid Dispersion 1 | 334 | 46 | — | 0 | 7.5 |
| | 2 | Liquid Dispersion 2 | 19 | Liquid Dispersion 1 | 350 | 46 | — | 0 | 10.5 |
| | 3 | Liquid Dispersion 2 | 19 | Liquid Dispersion 2 | 324 | 46 | — | 0 | 7.5 |
| | 4 | Liquid Dispersion 1 | 19 | Liquid Dispersion 3 | 324 | 46 | — | 0 | 7.5 |
| | 5 | Liquid Dispersion 3 | 19 | Liquid Dispersion 1 | 324 | 46 | — | 0 | 7.5 |
| | 6 | Liquid Dispersion 4 | 9 | Liquid Dispersion 1 | 334 | 46 | — | 0 | 7.5 |
| | 7 | Liquid Dispersion 1 | 23 | Liquid Dispersion 1 | 398 | 46 | — | 0 | 15.0 |
| | 8 | Liquid Dispersion 3 | 46 | Liquid Dispersion 1 | 322 | 46 | — | 0 | 10.5 |
| Colored Toner | 1-C | — | — | Liquid Dispersion 4 | 312 | 46 | (3) | 34 | 7.5 |
| | 1-M | — | — | Liquid Dispersion 4 | 312 | 46 | (2) | 34 | 7.5 |
| | 1-Y | — | — | Liquid Dispersion 4 | 312 | 46 | (1) | 34 | 7.5 |
| | 1-K | — | — | Liquid Dispersion 4 | 312 | 46 | (4) | 34 | 7.5 |
| | 2-C | Liquid Dispersion 1 | 22 | Liquid Dispersion 4 | 316 | 46 | (3) | 34 | 10.5 |
| | 2-M | Liquid Dispersion 1 | 22 | Liquid Dispersion 4 | 316 | 46 | (2) | 34 | 10.5 |
| | 2-Y | Liquid Dispersion 1 | 22 | Liquid Dispersion 4 | 316 | 46 | (1) | 34 | 10.5 |
| | 2-K | Liquid Dispersion 1 | 22 | Liquid Dispersion 4 | 316 | 46 | (4) | 34 | 10.5 |
| | 3-C | Liquid Dispersion 1 | 43 | Liquid Dispersion 4 | 346 | 46 | (3) | 34 | 15.0 |
| | 3-M | Liquid Dispersion 1 | 43 | Liquid Dispersion 4 | 346 | 46 | (2) | 34 | 15.0 |
| | 3-Y | Liquid Dispersion 1 | 43 | Liquid Dispersion 4 | 346 | 46 | (1) | 34 | 15.0 |
| | 3-K | Liquid Dispersion 1 | 43 | Liquid Dispersion 4 | 346 | 46 | (4) | 34 | 15.0 |

| | | Amount of Aluminum Sulfate (based on toner) | Initially Added Ion-Exchanged Water | After-Added Noncrystalline Polyester Resin Liquid Dispersion | Amount of Shell (out of toner 100) | Parameters in Production of Toner | | | | | | Shape Definition | Reflectance |
|---|---|---|---|---|---|---|---|---|---|---|---|---|---|
| | | % | f parts by weight | g parts by weight | % | s | t | u | v | w | x | (%) | (%) |
| Transparent Toner | 1 | 0.5 | 474 | 128 | 25 | 2.7 | 3 | 4 | 3.3 | 88 | 4 | 3.0 | 95 |
| | 2 | 0.7 | 504 | 102 | 20 | 2.9 | 3.2 | 3 | 3.5 | 92 | 3 | 4.8 | 93 |
| | 3 | 0.5 | 473 | 128 | 25 | 2.7 | 3 | 4 | 3.3 | 88 | 4 | 3.5 | 92 |
| | 4 | 0.5 | 473 | 128 | 25 | 2.7 | 3 | 4 | 3.3 | 88 | 4 | 3.0 | 94 |
| | 5 | 0.5 | 473 | 128 | 25 | 2.7 | 3 | 4 | 3.3 | 88 | 4 | 3.2 | 92 |
| | 6 | 0.5 | 474 | 128 | 25 | 2.7 | 3 | 4 | 3.3 | 88 | 4 | 3.0 | 91 |
| | 7 | 1 | 567 | 51 | 10 | 3.3 | 3.8 | 3 | 3.8 | 97 | 1 | 7.2 | 94 |
| | 8 | 0.7 | 504 | 102 | 20 | 2.7 | 3 | 4 | 3.5 | 86 | 5 | 4.0 | 85 |
| Colored Toner | 1-C | 0.5 | 477 | 128 | 25 | 2.7 | 3 | 4 | 3.3 | 90 | 4 | 2.8 | — |
| | 1-M | 0.5 | 477 | 128 | 25 | 2.7 | 3 | 4 | 3.3 | 90 | 4 | 3.0 | — |
| | 1-Y | 0.5 | 477 | 128 | 25 | 2.7 | 3 | 4 | 3.3 | 90 | 4 | 3.2 | — |
| | 1-K | 0.5 | 477 | 128 | 25 | 2.7 | 3 | 4 | 3.3 | 90 | 4 | 2.6 | — |
| | 2-C | 0.7 | 507 | 102 | 20 | 2.9 | 3.2 | 3 | 3.5 | 94 | 3 | 4.8 | — |
| | 2-M | 0.7 | 507 | 102 | 20 | 2.9 | 3.2 | 3 | 3.5 | 94 | 3 | 4.6 | — |
| | 2-Y | 0.7 | 507 | 102 | 20 | 2.9 | 3.2 | 3 | 3.5 | 94 | 3 | 4.8 | — |
| | 2-K | 0.7 | 507 | 102 | 20 | 2.9 | 3.2 | 3 | 3.5 | 94 | 3 | 4.5 | — |
| | 3-C | 1 | 569 | 51 | 10 | 3.3 | 3.8 | 3 | 3.8 | 98 | 1 | 7.5 | — |
| | 3-M | 1 | 569 | 51 | 10 | 3.3 | 3.8 | 3 | 3.8 | 98 | 1 | 7.4 | — |
| | 3-Y | 1 | 569 | 51 | 10 | 3.3 | 3.8 | 3 | 3.8 | 98 | 1 | 7.2 | — |
| | 3-K | 1 | 569 | 51 | 10 | 3.3 | 3.8 | 3 | 3.8 | 98 | 1 | 7.8 | — |

The transparent toners and colored toners obtained are shown in the Table below.

TABLE 4

| | | Ratio of Shape Factor of 0.90 to 0.94 in 7.5 to 15 μm % | Reflectance of Toner Powder for Light at 700 nm % | Amount (a) of Sulfonic Acid (Salt)-Containing Monomer in Crystalline Polyester Resin mol % | Monomers used in Crystalline Polyester Resin and Molar Ratio |
|---|---|---|---|---|---|
| Transparent Toner | 1 | 3 | 95 | 0 | 1,10-dodecane diacid/1,10-decanediol = 100/100 |
| | 2 | 4.8 | 93 | 0.4 | SDSP/1,10-dodecane diacid/1,9-nonanediol = 0.4/49.8/49.8 |
| | 3 | 3.5 | 92 | 0.4 | SDSP/1,10-dodecane diacid/1,9-nonanediol = 0.4/49.8/49.8 |
| | 4 | 3 | 94 | 0 | 1,10-dodecane diacid/1,10-decanediol = 100/100 |
| | 5 | 3.2 | 91 | 0.6 | SDSP/1,10-dodecane diacid/1,9-nonanediol = 0.6/49.7/49.7 |
| | 6 | 3 | 91 | 0.8 | SDSP/1,10-dodecane diacid/1,10-decanediol = 0.8/49.6/49.6 |
| | 7 | 7.2 | 94 | 0 | 1,10-dodecane diacid/1,10-decanediol = 100/100 |
| | 8 | 4 | 85 | 0.6 | SDSP/1,10-dodecane diacid/1,9-nonanediol = 0.6/49.7/49.7 |

TABLE 4-continued

| | | | | | |
|---|---|---|---|---|---|
| Colored Toner | 1 | 2.8 | — | — | — |
| | 2 | 4.8 | — | — | 1,10-dodecane diacid/1,10-decanediol = 100/100 |
| | 3 | 7.5 | — | — | 1,10-dodecane diacid/1,10-decanediol = 100/100 |

| | | Amount (b) of Crystalline Polyester Resin % | (a) * (b) | Monomers used in Noncrystalline Polyester Resin and Molar Ratio | Tg of Noncrystalline Polyester Resin (A, B) ° C. |
|---|---|---|---|---|---|
| Transparent Toner | 1 | 2 | 0 | TPA/FA/DSA/TMA = 63/0/33/5 BisAEO/BisAPO = 10/90 | (A) 57.8 |
| | 2 | 4 | 1.6 | TPA/FA/DSA/TMA = 63/0/33/5 BisAEO/BisAPO = 10/90 | (A) 57.8 |
| | 3 | 4 | 1.6 | TPA/TMA = 95/5 PG/NPG = 90/10 | (A) 58.5 |
| | 4 | 4 | 0 | TPA/FA/DSA/TMA = 60/5/30/5 BisAEO/BisAPO = 50/50 | (A) 55.7 |
| | 5 | 4 | 2.4 | TPA/FA/DSA/TMA = 63/0/33/5 BisAEO/BisAPO = 10/90 | (A) 57.8 |
| | 6 | 3 | 2.4 | TPA/FA/DSA/TMA = 63/0/33/5 BisAEO/BisAPO = 10/90 | (A) 57.8 |
| | 7 | 5 | 0 | TPA/FA/DSA/TMA = 63/0/33/5 BisAEO/BisAPO = 10/90 | (A) 57.8 |
| | 8 | 10 | 6 | TPA/FA/DSA/TMA = 63/0/33/5 BisAEO/BisAPO = 10/90 | (A) 57.8 |
| Colored Toner | 1 | — | — | TPA/FA/DSA/TMA = 60/7/25/8 BisAEO/BisAPO = 50/50 | (B) 55.1 |
| | 2 | 5 | — | TPA/FA/DSA/TMA = 60/7/25/8 BisAEO/BisAPO = 50/50 | (B) 55.1 |
| | 3 | 10 | — | TPA/FA/DSA/TMA = 60/7/25/8 BisAEO/BisAPO = 50/50 | (B) 55.1 |

<Production of Carrier>

| | |
|---|---|
| Toluene | 14 parts |
| Styrene-methyl methacrylate copolymer (component ratio: 80/20, weight average molecular weight: 70,000) | 2 parts |
| MZ500 (zinc oxide, produced by Titan Kogyo K.K.) | 0.6 parts |

These components are mixed and stirred with a stirrer for 10 minutes to prepare a coat layer-forming solution in which zinc oxide is dispersed. This coat solution and 100 parts of ferrite particle (volume average particle diameter: 38 μm) are charged into a vacuum deaeration-type kneader, stirred at 60° C. for 30 minutes and dried by deaeration under reduced pressure while heating to produce a carrier <Production of Electrostatic Image Developer>

The obtained carrier and toner are mixed in a ratio of 100 parts:8 parts in a 2 liter-volume V blender to produce an electrostatic image developer.

(Image Forming Method)

The obtained developer is filled in a developing machine shown in the drawing, which is modified DocuCentre-III C7600 manufactured by Fuji Xerox Co., Ltd. of quintuple tandem system (modified quintuple tandem machine for duplex printing).

<Evaluation Method>

An image is formed on MCP256 paper by using Test Chart No. 1R issued from the Imaging Society of Japan and evaluated for the following two points. The transparent toner image is formed entirely (formed in the non-image area and the image area).

(1) The 60° gloss in the non-image area is measured at 10 points and the standard deviation is determined.

(2) The 60° gloss in the image area is measured at 10 points and the standard deviation is determined.

The criteria are as follows.

A: The standard deviation is 1 or less.

B: The standard deviation is 3 or less.

C: The standard deviation is 5 or less.

D: The standard deviation is 5 or more.

The results are shown in the Table below.

TABLE 5

| | Transparent Toner | Colored Toner | Noncrystalline Polyester Resin, ΔTg (B-A) (° C.) | Evaluation Result 1 | Evaluation Result 2 | Overall Evaluation |
|---|---|---|---|---|---|---|
| 1 Example | 1 | 1 | 2.7 | A | A | A |
| 2 Example | 1 | 2 | 2.7 | A | B | B |
| 3 Example | 2 | 1 | 2.7 | B | B | B |
| 4 Example | 3 | 1 | 3.4 | B | B | B |
| 5 Example | 4 | 1 | 0.6 | A | C | C |
| 6 Example | 5 | 1 | 2.7 | C | C | C |
| 7 Example | 6 | 1 | 2.7 | C | C | C |
| 8 Example | 1 | 3 | 2.7 | A | C | C |
| 9 Comparative Example | 7 | 1 | 2.7 | D | A | D |
| 10 Comparative Example | 8 | 1 | 2.7 | D | A | D |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A toner set for electrostatic image development, comprising:

at least one colored toner comprising a coloring agent and a first noncrystalline polyester resin as a first binder resin; and a transparent toner comprising mother particles, a coloring agent in an amount of 0 to 1 wt. % based on a weight of the transparent toner, and a crystalline polyester resin and a second noncrystalline polyester resin as a second binder resin, wherein a content of the crystalline polyester resin in the transparent toner is from about 2 to about 10 wt. % based on the weight of the crystalline polyester resin and the second noncrystalline polyester resin of the second hinder resin, a proportion of particles in the mother particles of the transparent toner having a shape factor of 0.94 or less is about 5% by number or less based on particles having a particle diameter of 7.5 to 15 μm, a reflectance of the mother particles of the transparent toner is about 90% or more for light at a wavelength of 700 nm, and a volume average particle diameter $D_{50v}$ of the transparent toner is 3.0 μm to 9.0 μm.

2. The toner set according to claim 1, wherein a shape factor of the mother particles of the transparent toner as a whole is from about 0.950 to about 0.975.

3. The toner set according to claim 1, wherein the reflectance of the mother particles of the transparent toner is about 93% or more for light at a wavelength of 700 nm.

4. The toner set according to claim 1, wherein a crystal melting temperature Tm of the crystalline polyester resin is from about 50 to about 100° C.

5. The toner set according to claim 1, wherein a weight average molecular weight of the crystalline polyester resin is from about 10,000 to about 60,000.

6. The toner set according to claim 1, wherein an amount of a monomer unit derived from a polyvalent carboxylic acid having a sulfonic acid group in the crystalline polyester resin contained in the transparent toner is (a) mol %, a ratio of the crystalline polyester resin to the total amount of the crystalline polyester resin and the second noncrystalline polyester resin in the transparent toner is (b), and (a)×(b) is about 4 mol % or less.

7. The toner set according to claim 1, wherein at least one of the first noncrystalline polyester resin and the second noncrystalline polyester resin contains a noncrystalline polyester resin polymerized using a polycondensable monomer having an aromatic group.

8. The toner set according to claim 1, wherein the second noncrystalline polyester resin contained in the transparent toner contains a noncrystalline polyester resin polymerized using a polycondensable monomer having an aromatic group.

9. The toner set according to claim 8, wherein the polycondensable monomer having an aromatic group has a bisphenol A structure.

10. The toner set according to claim 1, wherein a glass transition temperature of the first noncrystalline polyester resin contained in the colored toner is Tg(A) a glass transition temperature of the second noncrystalline polyester resin contained in the transparent toner is Tg(B), and Tg(B)−Tg(A)≧2° C.

11. The toner set according to claim 1, wherein the colored toner contains a yellow toner, a magenta toner and a cyan toner.

12. The toner set according to claim 1, wherein each of the colored toner and the transparent toner independently contains a release agent.

13. The toner set according to claim 12, wherein an amount of the release agent added is from about 1 to about 20 wt % based on the total amount of each of the transparent toner and the colored toner.

14. The toner set according to claim 1, wherein a content of the crystalline polyester resin in the transparent toner is from about 2 to about 8 wt. % based on the weight of the crystalline polyester resin and the second noncrystalline polyester resin of the second binder resin.

15. The toner set according to claim 1, wherein a content of the crystalline polyester resin in the transparent toner is from about 2 to about 6 wt. % based on the weight of the crystalline polyester resin and the second noncrystalline polyester resin of the second binder resin.

16. The toner set according to claim 1, wherein the volume average particle diameter $D_{50v}$ of the transparent toner is 3.0 μm to 8.0 μm.

17. The toner set according to claim 1, wherein the volume average particle diameter $D_{50v}$ of the transparent toner is 3.0 μm to 7.0 μm.

18. An image forming method, comprising:

forming an electrostatic latent image on a latent image holding member;

developing the electrostatic latent image formed on the latent image holding member by using the toner set for electrostatic image development according to claim 1 held on a developer holding member to form a toner image;

transferring the toner image formed on the latent image holding member onto a transfer-receiving material; and fixing the toner image transferred onto the transfer-receiving material.

19. An image forming apparatus, comprising:

a latent image holding member;

a charging unit that electrically charges the latent image holding member;

an exposure unit that exposes the electrically charged latent image holding member to form an electrostatic latent image on the latent image holding member;

a developing unit comprising the toner set according to claim 1 that develops the electrostatic latent image with the toner set to form a toner image;

a transfer unit that transfers the toner image onto a transfer-receiving material from the latent image holding member; and a fixing unit that fixes the toner image.

20. The image forming apparatus according to claim 19, wherein the transfer unit includes a primary transfer unit that transfers the toner image onto an intermediate transfer material and a secondary transfer unit that transfers the toner image transferred onto the intermediate transfer material, onto a recording medium.

* * * * *